US009409195B2

(12) United States Patent
DeJong et al.

(10) Patent No.: US 9,409,195 B2
(45) Date of Patent: Aug. 9, 2016

(54) TRIGGER SPRAYER VALVES

(75) Inventors: David L. DeJong, Ogden, UT (US); Steven L. Sweeton, Lake Winnebago, MO (US); Joseph K. Dodd, Lee's Summit, MO (US)

(73) Assignee: WestRock Dispensing Systems, Inc., Norcross, GA (US)

( * ) Notice: Subject to any disclaimer, the term of this patent is extended or adjusted under 35 U.S.C. 154(b) by 856 days.

(21) Appl. No.: 13/405,456

(22) Filed: Feb. 27, 2012

(65) Prior Publication Data

US 2012/0261438 A1 Oct. 18, 2012

Related U.S. Application Data

(60) Provisional application No. 61/474,888, filed on Apr. 13, 2011.

(51) Int. Cl.
*B67D 7/58* (2010.01)
*B05B 11/00* (2006.01)

(52) U.S. Cl.
CPC ..... *B05B 11/3011* (2013.01); *B05B 11/3016* (2013.01); *B05B 11/3069* (2013.01); *B05B 11/3077* (2013.01)

(58) Field of Classification Search
USPC ..... 222/383.1, 340, 341, 380
See application file for complete search history.

(56) References Cited

U.S. PATENT DOCUMENTS

| | | | | | |
|---|---|---|---|---|---|
| 4,191,313 | A | * | 3/1980 | Blake et al. | 222/335 |
| 4,489,861 | A | * | 12/1984 | Saito et al. | 222/207 |
| 4,596,344 | A | | 6/1986 | Corsette | |
| 5,318,206 | A | * | 6/1994 | Maas et al. | 222/383.1 |
| 5,425,482 | A | * | 6/1995 | Foster et al. | 222/207 |
| 5,467,900 | A | | 11/1995 | Maas | |
| 5,522,547 | A | | 6/1996 | Dobbs | |
| 5,553,752 | A | * | 9/1996 | Foster et al. | 222/340 |
| 5,730,335 | A | | 3/1998 | Maas | |
| 5,806,724 | A | | 9/1998 | Foster | |
| 5,984,149 | A | * | 11/1999 | Thanisch et al. | 222/340 |
| 6,131,820 | A | | 10/2000 | Dodd | |
| 6,364,172 | B1 | * | 4/2002 | Maas et al. | 222/383.1 |
| 6,364,175 | B2 | * | 4/2002 | Bloom | 222/383.1 |
| 7,175,056 | B2 | * | 2/2007 | Buti | 222/383.1 |
| 7,775,405 | B2 | | 8/2010 | Sweeton | |
| 2004/0222243 | A1 | * | 11/2004 | Sweeton | 222/383.1 |
| 2008/0230563 | A1 | * | 9/2008 | Maas et al. | 222/383.1 |

FOREIGN PATENT DOCUMENTS

| | | |
|---|---|---|
| EP | 0798050 | 10/1997 |
| WO | WO2011128787 A1 | 10/2011 |

* cited by examiner

*Primary Examiner* — Nicholas J Weiss
(74) *Attorney, Agent, or Firm* — WestRock Intellectual Property Group

(57) ABSTRACT

A trigger sprayer having a valve body configured to accept a discharge valve for a pre-compression configuration or a valve and plug combination for a non-pre-compression configuration where the discharge valve may include a frame and valve which may be bi-injected or assembled to provide a pre-compression valve for the trigger sprayer.

11 Claims, 24 Drawing Sheets

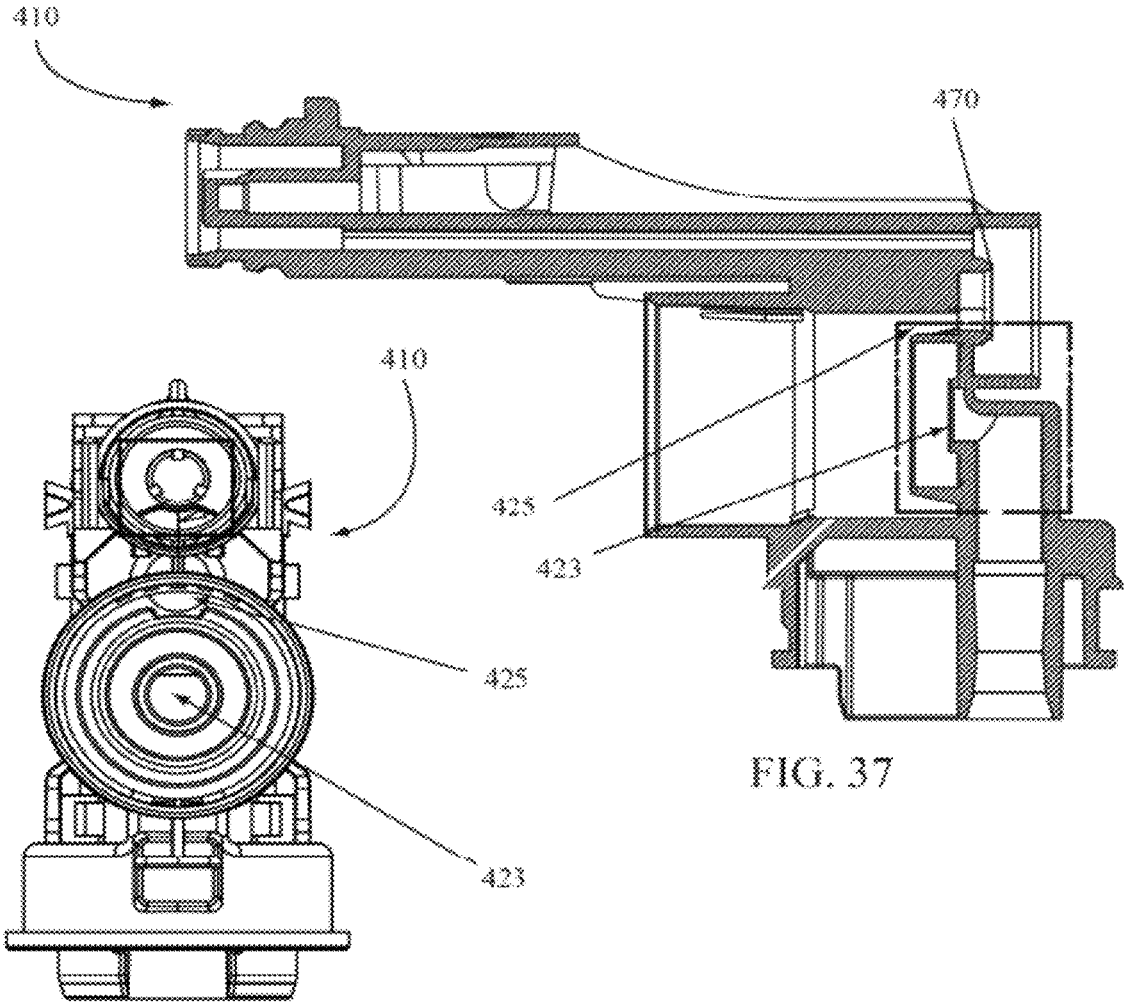
FIG. 37
FIG. 38
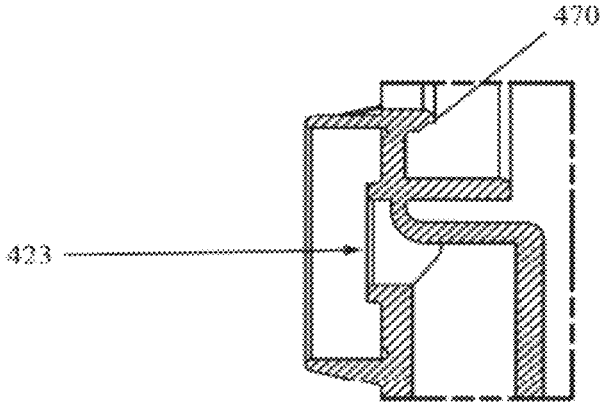
FIG. 39

TRIGGER SPRAYER VALVES

CROSS-REFERENCE TO RELATED APPLICATIONS

This application claims the benefit of, and priority to, U.S. Provisional Application No. 61/474,888, entitled "TRIGGER SPRAYERS AND METHODS FOR MAKING THE SAME," filed 13 Apr. 2011, and incorporates the same herein by reference in its entirety.

BACKGROUND OF THE INVENTION

1. Field of the Invention

Embodiments of the invention relate to trigger sprayer valves and more particularly to inlet and discharge valves used with trigger sprayers, including improved pre-compression discharge valves.

2. State of the Art

Trigger sprayers are well known and are commonly used as delivery devices to deliver a product, such as a liquid, from a container to a surface or an area in which the product is desired. For example, trigger sprayers may be used to apply cleaning agents to hard surfaces or to deliver air freshener to a volume of air. The use and applications for such devices are well known.

A conventional trigger sprayer typically includes a valve body having an inlet and an outlet. A pump chamber may be formed in the valve body and a piston may be seated in the pump chamber and moveable therein to alter the volume of the pump chamber. A piston is typically attached to a trigger and the trigger, piston, or both trigger and piston may be biased by a spring. An inlet valve in communication with the valve body inlet and the pump chamber regulates the flow of product into the pump chamber. Similarly, an outlet valve seated between the pump chamber and the valve body outlet regulates flow of a product out of the pump chamber and through the valve body outlet. The valve body may be attached to or in communication with a container holding a product. The connection may be made with a closure system such as a bayonet system integrated with the valve body or a screw connection mated with the valve body as known in the art.

Examples of trigger sprayers are illustrated and described in U.S. Pat. No. 5,467,900, U.S. Pat. No. 7,175,056 and PCT Publication WO2010124040, each of which are incorporated herein by reference in their entireties.

While there are numerous trigger sprayer designs available in the market, improvements and new designs are continually being developed. For example, new all-plastic designs may be desirable so that the trigger sprayer may be easily recycled. New designs may also offer improved economics or reduced material weight and part counts. In other instances, it may be desirable for a trigger sprayer to include a pre-compression feature which allows for the build-up of pressure prior to the release of a product through an outlet valve such that the pressure build-up is such that a sufficient force is applied to the product being dispensed to create a desired spray pattern or to achieve finer particle sizes upon dispensing. Pre-compression systems may also be desirable for other reasons. An example of a pre-compression valve system for a trigger sprayer is described and illustrated in U.S. Pat. No. 5,467,900. Improvements in such pre-compression valves may enhance the performance or user acceptance of a trigger sprayer.

In still other instances, it may be desirable to have a trigger sprayer valve body design which may be fitted with either a pre-compression valve system for those applications desiring pre-compression or a non-pre-compression valve system for use when pre-compression is not desired.

BRIEF SUMMARY OF THE INVENTION

According to certain embodiments of the invention, various pre-compression systems are incorporated with a trigger sprayer to provide a pre-compression option for a trigger sprayer.

According to some embodiments of the invention, a trigger sprayer may include a two piece discharge valve. A first valve component may be seated on a valve seat and held in position by a frame. The frame may interlock with, attach to, or be otherwise secured to the valve body of the trigger sprayer to secure the valve on the valve seat.

According to other embodiments of the invention, a trigger sprayer valve body may be configured to accept a pre-compression valve or a non-pre-compression valve such that a trigger sprayer having a pre-compression option may be made from a majority of the same parts used for a non-pre-compression version of the same trigger sprayer.

In some embodiments of the invention, a trigger sprayer may include an option for a pre-compression discharge valve or a non-pre-compression discharge valve. In certain embodiments, a pre-compression discharge valve may include a bi-injected, two material discharge valve. In other embodiments, a bi-injected discharge valve may be made of the same material having different stiffness, rigidity, or other features and characteristics. In still other embodiments, a pre-compression discharge valve may include a valve member and a frame member.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

FIG. 37 illustrates a cross-sectional view of a valve body according to various embodiments of the invention;

FIG. 38 illustrates a front-view of a valve body according to various embodiments of the invention;

FIG. 39 illustrates a close-up view of a portion of the valve body illustrated in FIG. 37;

DETAILED DESCRIPTION OF THE INVENTION

According to various embodiments of the invention, a trigger sprayer may include a discharge valve which allows a pressure build-up or pre-compression prior to the unseating of the discharge valve. In some embodiments of the invention, a valve body may be configured to accept either a discharge valve capable of providing pre-compression to the trigger sprayer or a valve and plug for use in those applications where pre-compression is not desired.

Figure 1:
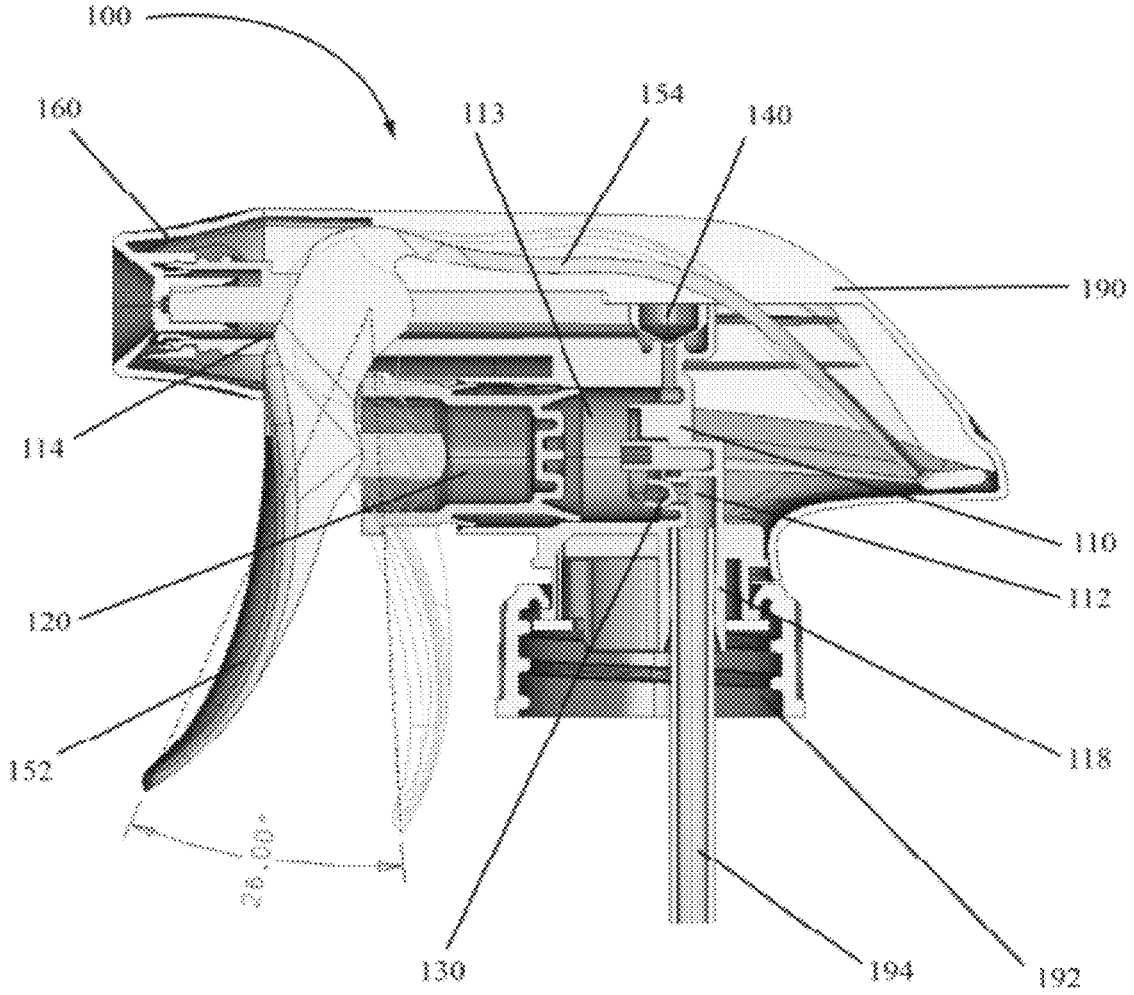
FIG. 1 illustrates a cross-sectional view of a trigger sprayer according to various embodiments of the invention.

A trigger sprayer 100 according to some embodiments of the invention is illustrated in FIG. 1. As illustrated, a trigger sprayer 100 may include a valve body 110. The valve body 110 may include an inlet 112 and an outlet 114. The inlet 112 and outlet 114 may be in communication with a pump chamber 113. A piston 120 may be seated in the pump chamber 113. An inlet valve 130 may be seated in a valve seat between the inlet 112 and the pump chamber 113. A discharge valve 140 may be seated in a valve seat between the pump chamber 113 and the outlet 114. In some embodiments, a tube retainer 118 may integrally formed with the valve body 110 as illustrated. In other embodiments, a tube retainer may fit into a portion of the valve body 110. A nozzle 160 may be fitted or mated with the valve body 110 as known. The trigger sprayer 100 may also include a shroud 190 attached to or mated with the valve body 110 and an attachment system 192 for securing the trigger sprayer 100 to a container. The attachment system 192 may include a bayonet attachment system molded with the valve body 110, a bayonet attachment system molded in a separate part, a screw-type attachment system molded as a separate part, or any other conventional attachment system. The trigger sprayer 100 may also include a dip tube 194 secured in a tube retainer 118.

A trigger 152 and spring 154 may also be included as part of a trigger sprayer 100. While an integrated trigger 152 and spring 154 combination is illustrated in various figures herein, it is understood that various embodiments of the invention may incorporate other trigger 152 and spring 154 combinations, including such combinations where the trigger 152 and spring 154 are not integrated as a single component. For example, a conventional trigger and metal coil spring or plastic spring may be used with various embodiments of the invention.

According to embodiments of the invention, the discharge valve 140 may be made of a flexible material having the ability to flex or deform upon the exertion of a certain amount of force on the discharge valve 140. For example, the material used for a discharge valve 140 may be selected based upon the desired discharge force. In some embodiments the discharge valve 140 may be made of an elastomeric material. In other embodiments, the discharge valve 140 may be made of a flexible material, a plastic material, a urethane material, a silicon material or any other desired material.

As illustrated in FIG. 1, a discharge valve 140 may be seated in a valve seat in the valve body 110. The valve seat may be located in a top portion of the valve body 110 such that during assembly a discharge valve 140 may be seated in the valve seat opening in the valve body 110. A shroud 190 may then be assembled to the valve body 110 and a portion of the shroud 190 may secure the discharge valve 140 in its seated position. As product is pumped out of the pump chamber 113 it may contact the discharge valve 140 and apply a pressure against the discharge valve 140. According to various embodiments of the invention, the discharge valve 140 will maintain a seal against the valve seat until a pre-determined pressure is reached at which time the discharge valve 140 will unseat and allow product to pass by the discharge valve 140 and towards the outlet 114.

Figure 2:
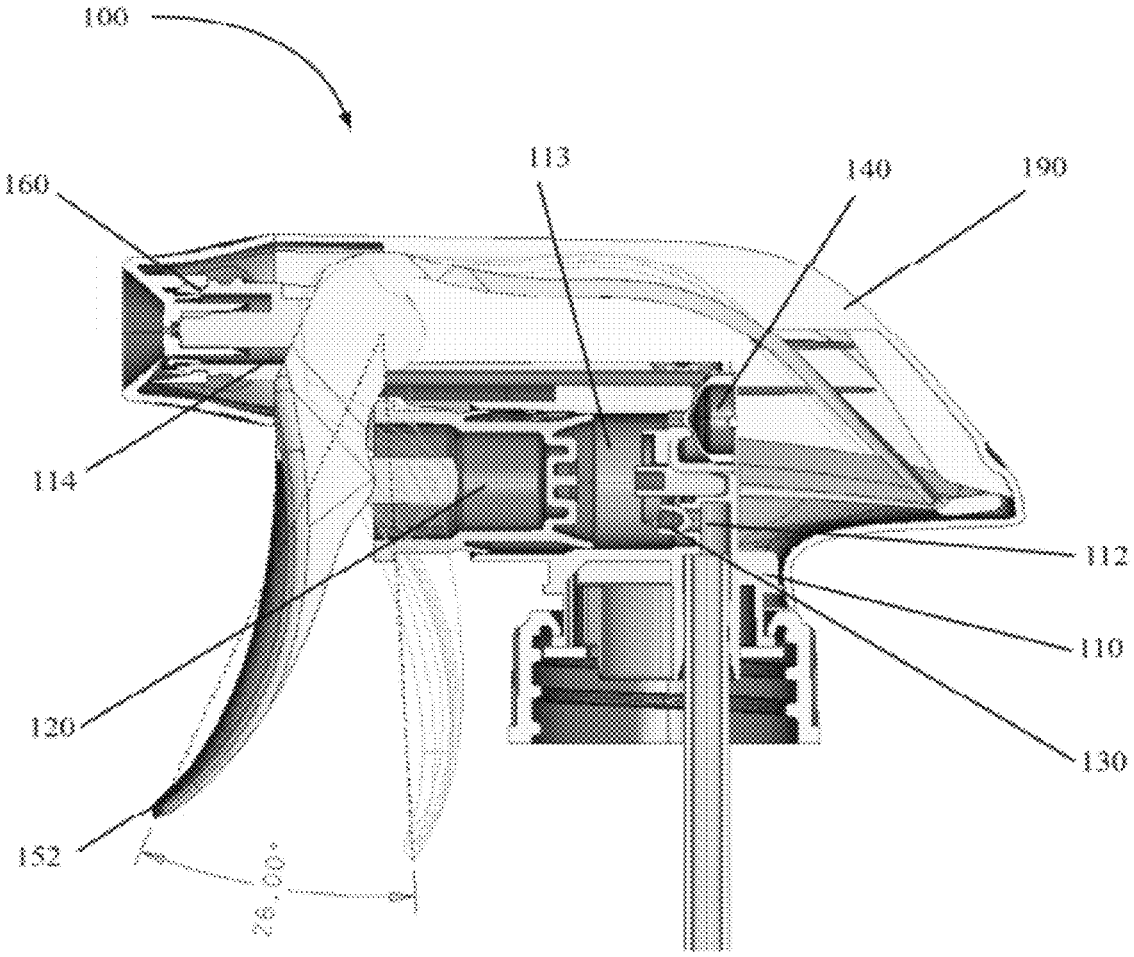
FIG. 2 illustrates a cross-sectional view of a trigger sprayer according to various embodiments of the invention.

A trigger sprayer 100 according to other embodiments of the invention is illustrated in FIG. 2. As illustrated, the trigger sprayer 100 includes a valve body 110 having an inlet 112 and an outlet 114. An inlet valve 130 may be seated in a valve seat between the inlet 112 and the pump chamber 113. A discharge valve 140 may be seated in a valve seat between the pump chamber 113 and the outlet 114. As illustrated in FIG. 2, the valve seat for the discharge valve 140 may be located in a rear portion of the valve body 110 rather than on a top portion of the valve body 110 as illustrated in FIG. 1.

The discharge valve 140 of the trigger sprayer 100 illustrated in FIG. 2 may be retained within the valve seat in part by a portion of the shroud 190. As the trigger 152 is actuated, the piston 120 is moved in the pump chamber 113, applying force to the product in the pump chamber 113 which in turn applies force to the discharge valve 140. Once the force on the discharge valve 140 reaches a force capable of unseating the discharge valve 140, the discharge valve unseats and allows product to pass the discharge valve 140 and flow to the outlet 114.

As with the discharge valve 140 illustrated in FIG. 1, the discharge valve 140 illustrated in FIG. 2 may be made of a flexible or elastomeric material. The material of the discharge valve 140 may be selected to provide particular characteristics to the discharge valve 140, such as a sufficient rigidity or stiffness to prevent deformation or movement of the discharge valve 140 until a certain amount of force or pressure is applied to the discharge valve 140. In some embodiments, the discharge valve 140 may also be shaped or engineered to provide desired characteristics. For example, the thickness of material may be altered or varied or ribs or other supporting structures may be designed as part of the discharge valve 140 to achieve the desired characteristics.

Figure 3:
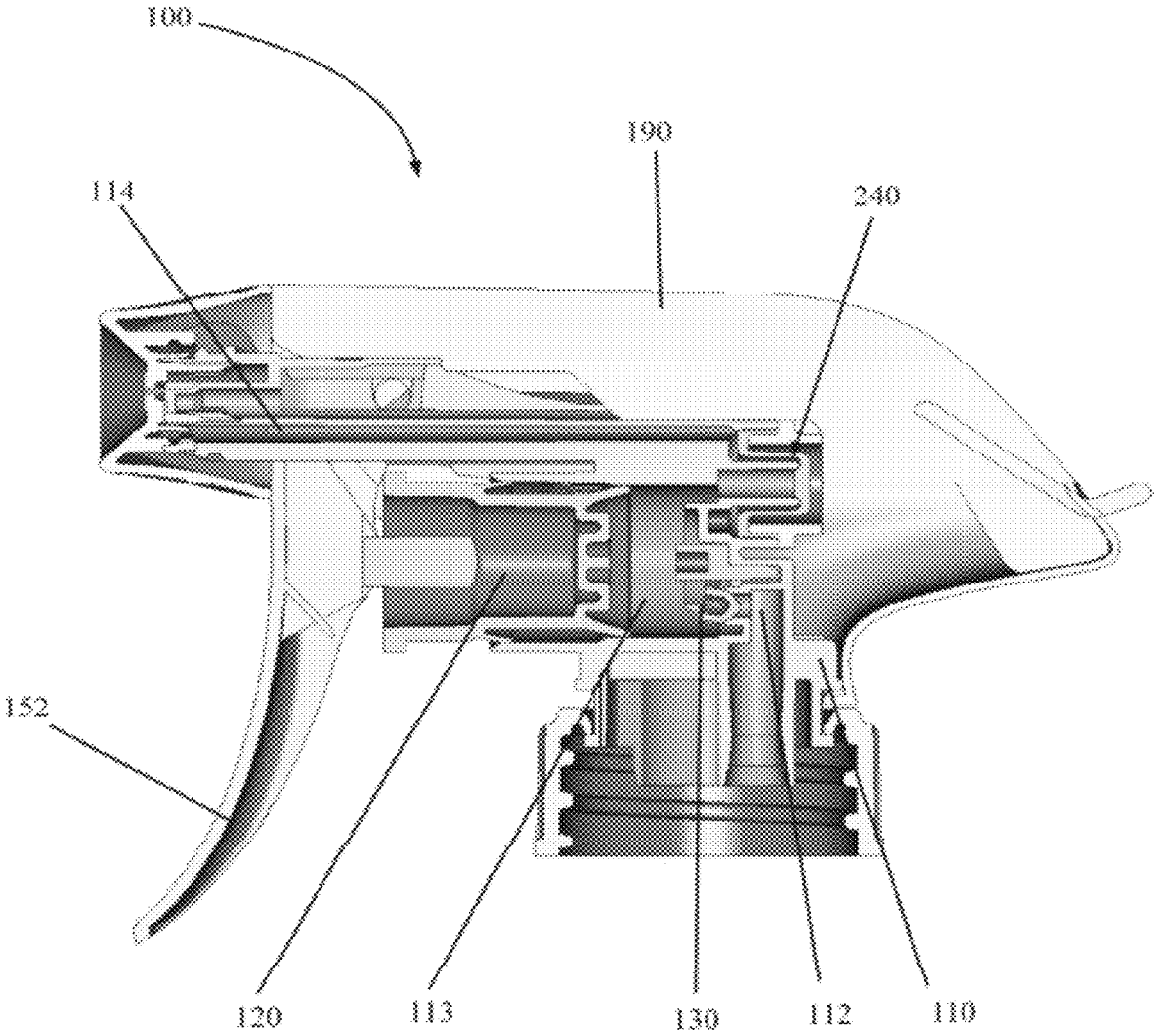
FIG. 3 illustrates a cross-sectional view of a trigger sprayer according to various embodiments of the invention.

A trigger sprayer 100 according to other embodiments of the invention is illustrated in FIG. 3. While the configuration of the valve body 110 is similar to other embodiments of the invention, the discharge path from the pump chamber 113 to the outlet 114 may be configured differently and the discharge valve 240 may include a bi-injected discharge valve 240 assembly or multi-component discharge valve 240 assembly.

Figure 4:
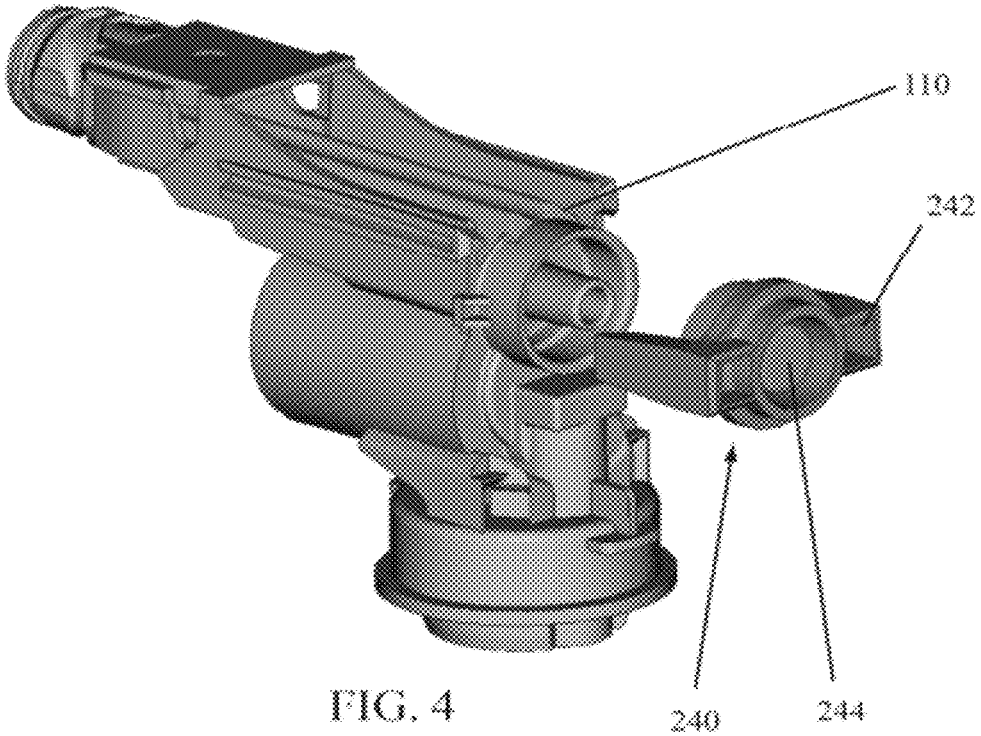
FIG. 4 illustrates a blown apart view of a valve body and discharge valve according to embodiments of the invention.
Figure 5:
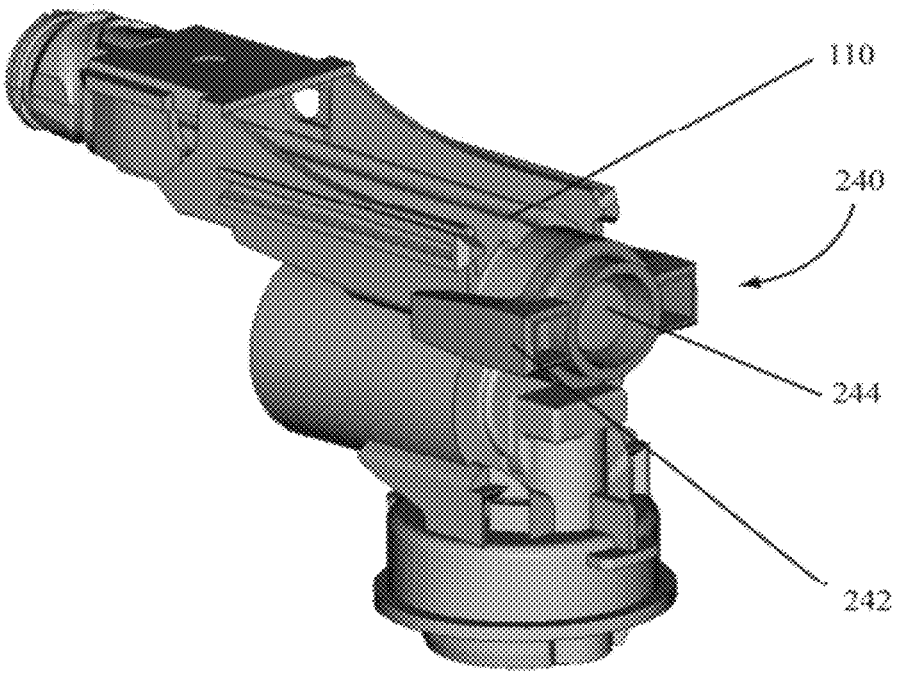
FIG. 5 illustrates a rear view of a discharge valve assembled with a valve body according to various embodiments of the invention.
Figure 6:
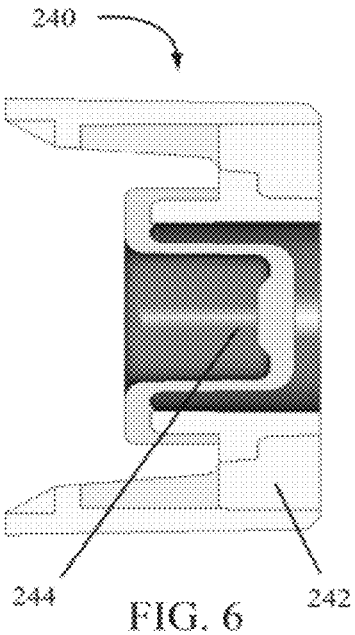
FIG. 6 illustrates a cross-sectional view of a discharge valve according to various embodiments of the invention.
Figure 7:
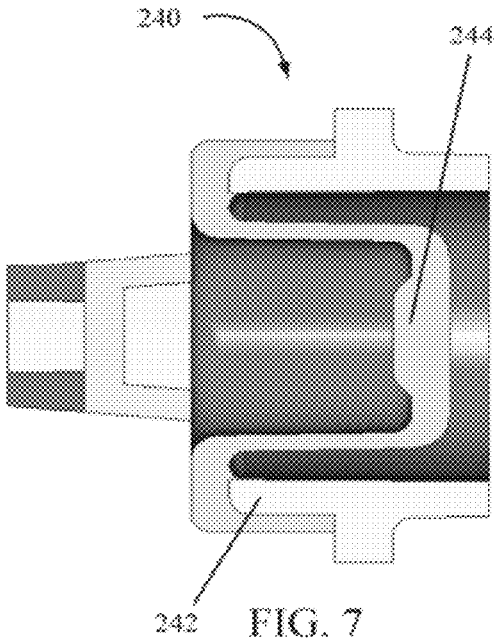
FIG. 7 illustrates a cross-sectional view of a discharge valve according to various embodiments of the invention.
Figure 8:
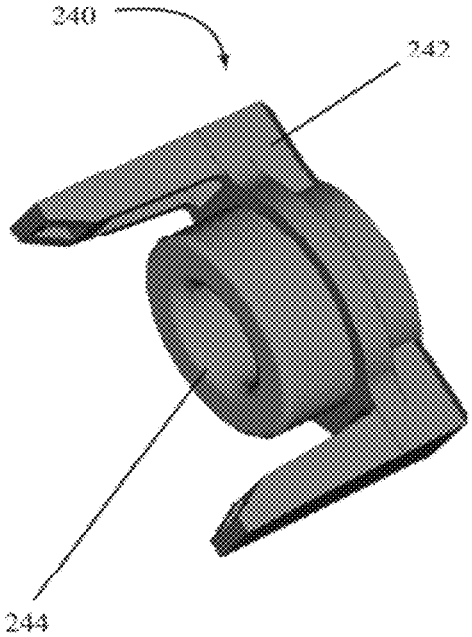
FIG. 8 illustrates a discharge valve according to various embodiments of the invention.
Figure 9:
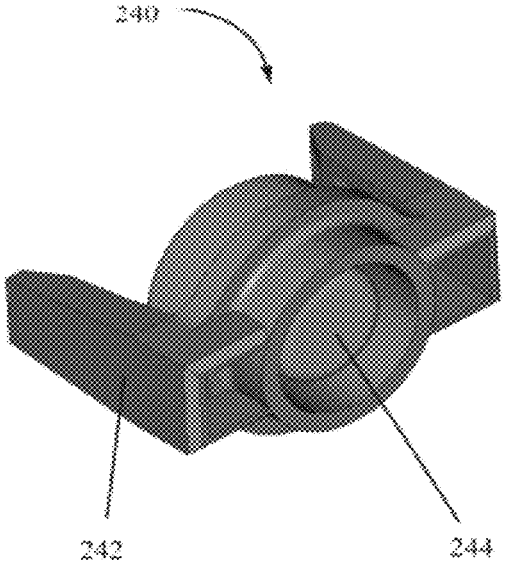
FIG. 9 illustrates a discharge valve according to various embodiments of the invention.

For example, a cross-sectional view of a discharge valve 240 according to various embodiments of the invention is illustrated in FIGS. 6 and 7 and a discharge valve 240 is illustrated in FIGS. 8 and 9. Assembly of a discharge valve 240 with a valve body 110 according to various embodiments of the invention is illustrated in FIGS. 4 and 5.

According to various embodiments of the invention, a discharge valve 240 may include a frame 242 and a valve 244 as illustrated in FIGS. 4 through 9. The frame 242 and valve 244 may be bi-injected or formed of multiple components. According to some embodiments of the invention, a frame 242 may be formed of polypropylene or other plastic material. According to some embodiments of the invention, a valve 244 may be formed of an olefin based polymer, silicon, other polymer material, or plastic material. While various materials for the frame 242 and valve 244 are described herein, other materials may also be used and the various embodiments of the invention are not limited by the selection of materials for the discharge valve 240.

A discharge valve 240 according to various embodiments of the invention may have a valve 244 bi-injected or mated with a frame 242 such that the frame 242 may support the valve 244. For example, as illustrated in FIGS. 8 and 9, a valve 244 may be encompassed by and supported by the frame 242. As illustrated in FIGS. 6 and 7, a portion of the valve 244 may sit within an opening in the frame 242 and a portion of the valve 244 may wrap around a portion of the frame 242. When assembled to a valve body 110 as illustrated in FIGS. 4 and 5, the frame 242 may secure the valve 244 in a seated position on a portion of the valve body 110. According to some embodiments of the invention, a frame 242 may also include features to help secure the frame 242 to the valve body 110. For example, a frame 242 may include snap beads, locking projections or other configurations which allow the frame 242 to be secured to the valve body 110. A valve body 110 may also include features to help retain a frame 242 to the valve body 110 when assembled.

Figure 10:
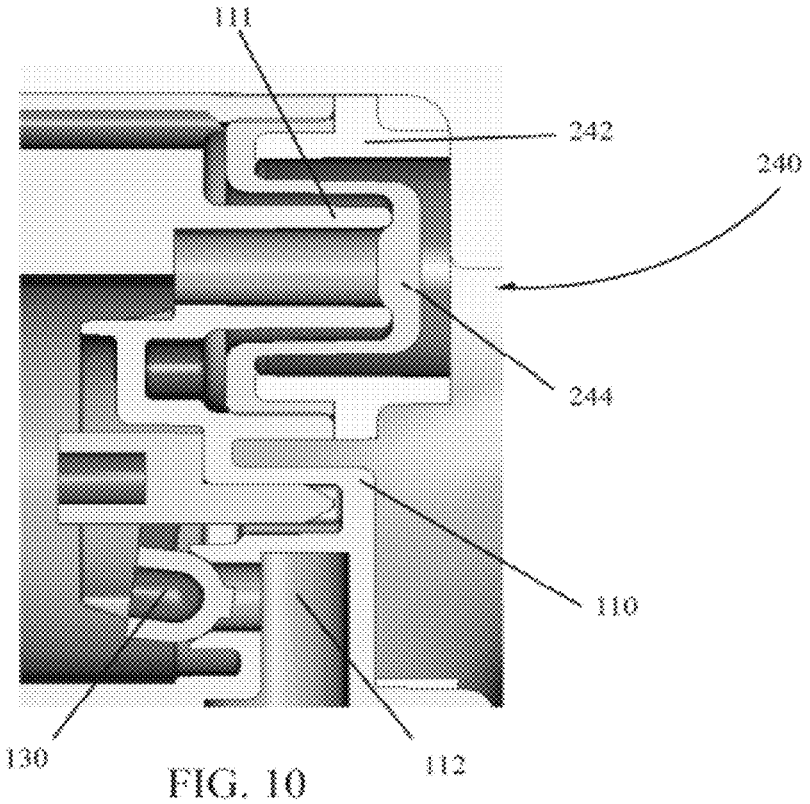
FIG. 10 illustrates a cross-sectional view of a discharge valve assembled with a valve body and inlet valve according to various embodiments of the invention.

A close-up, cross-sectional view of a discharge valve 240 assembled with a valve body 110 according to various embodiments of the invention is illustrated FIG. 10. As shown, a discharge valve 240 may be assembled to a valve body 110. The valve 244 portion of the discharge valve 240 may be seated against an outlet portion 111 of the valve body 110. Upon the flow of a product through the outlet portion 111 of the valve body 110, the product may apply a force against the valve 244 seated against the outlet portion 111. Such pressure may flex the valve 244 or cause the valve 244 to move such that a product may pass by the discharge valve 240 and the outlet 114 of the trigger sprayer 100.

As illustrated, the frame 242 of the discharge valve 240 may secure the valve 244 in a seated position. Once sufficient pressure on the valve 244 is removed, the valve 244 may reseat on the outlet portion 111 of the valve body 110. The frame 242 may help retain the valve 244 in the proper position. For example, the positioning of the frame 242 with respect to the valve body 110 may secure the valve 244 in a position that prevents blow-outs of the valve 244. The frame 242 may prevent such blow-outs because the valve 244 is retained upstream of the outlet portion 111 by the frame 242. Thus, when the valve 244 is opened it is stretched and may be pulled back to a seated position by the elastic characteristics or features of the valve 244 material. Such a configuration may provide improved seating for a pre-compression valve.

Figure 11:
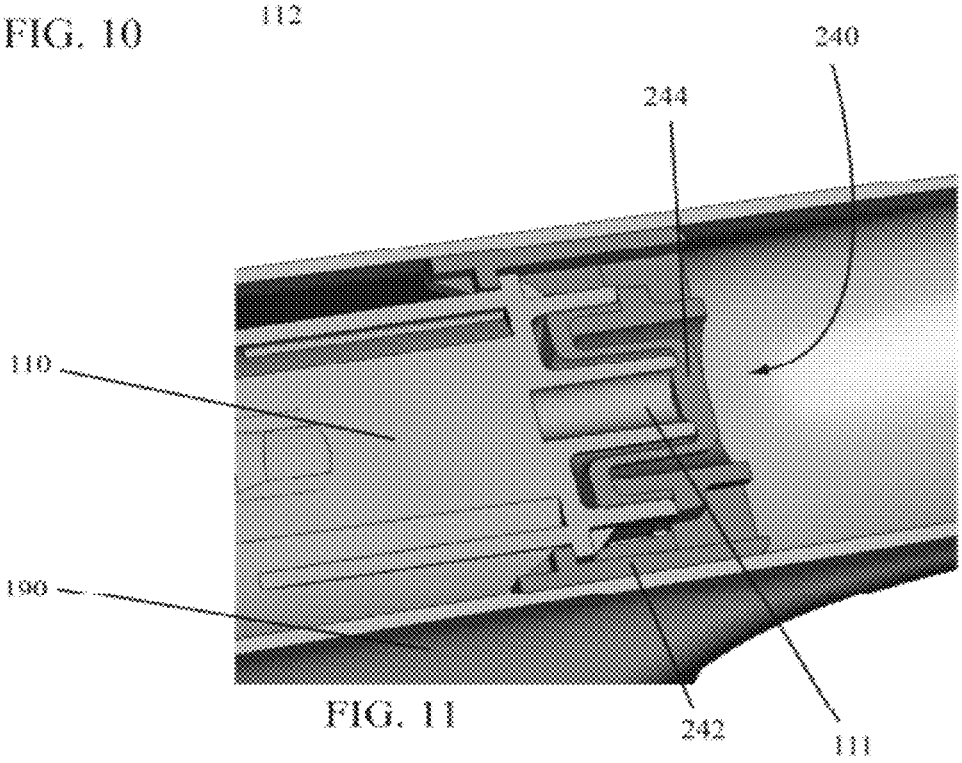
FIG. 11 illustrates a cross-sectional view of a discharge valve assembled with a valve body and shroud according to various embodiments of the invention.

A discharge valve 240 may be secured to a valve body 110 in various ways. According to some embodiments of the invention, a discharge valve 240 may be secured as illustrated in FIG. 11. In some embodiments, the frame 242 of a discharge valve 240 may include projections which may mate with or contact projections or tabs on a valve body 110. The contact of the projections may hold a frame 242 in place during operation of a trigger sprayer 100. In other embodiments, a shroud 190 may also hold the discharge valve 240 in place or assist with the mating of a discharge valve 240 with a valve body 110. As illustrated in FIG. 11, a shroud 190 may frictionally fit against a frame 242 of a discharge valve 240 to retain or help retain the frame 242 in communication with a valve body 110. The positioning of portions of the shroud 190 around the frame 242 or against the frame 242 may secure the frame 242 in an assembled position. In addition, a frame 242 may include projections which mate with a shroud 190 or a shroud 190 may include projections that mate with the frame 242 such that the frame 242 and shroud 190 may be locked or mated together.

Although a discharge valve 240 according to certain embodiments of the invention may be bi-injected, a discharge valve 240 may also be assembled from two or more parts. For example, the frame 242 may be molded and assembled with a valve 244 which is molded separately. The frame 242 and valve 244 may be snap-fit together, welded together, glued together, or otherwise assembled as a single discharge valve 240 assembly. In other embodiments, a frame 242 and valve 244 may not be connected but instead press-fit or friction fit together or in a sealing configuration during assembly with a valve body 110, shroud 190, or other components of a trigger sprayer 100.

Figure 12:
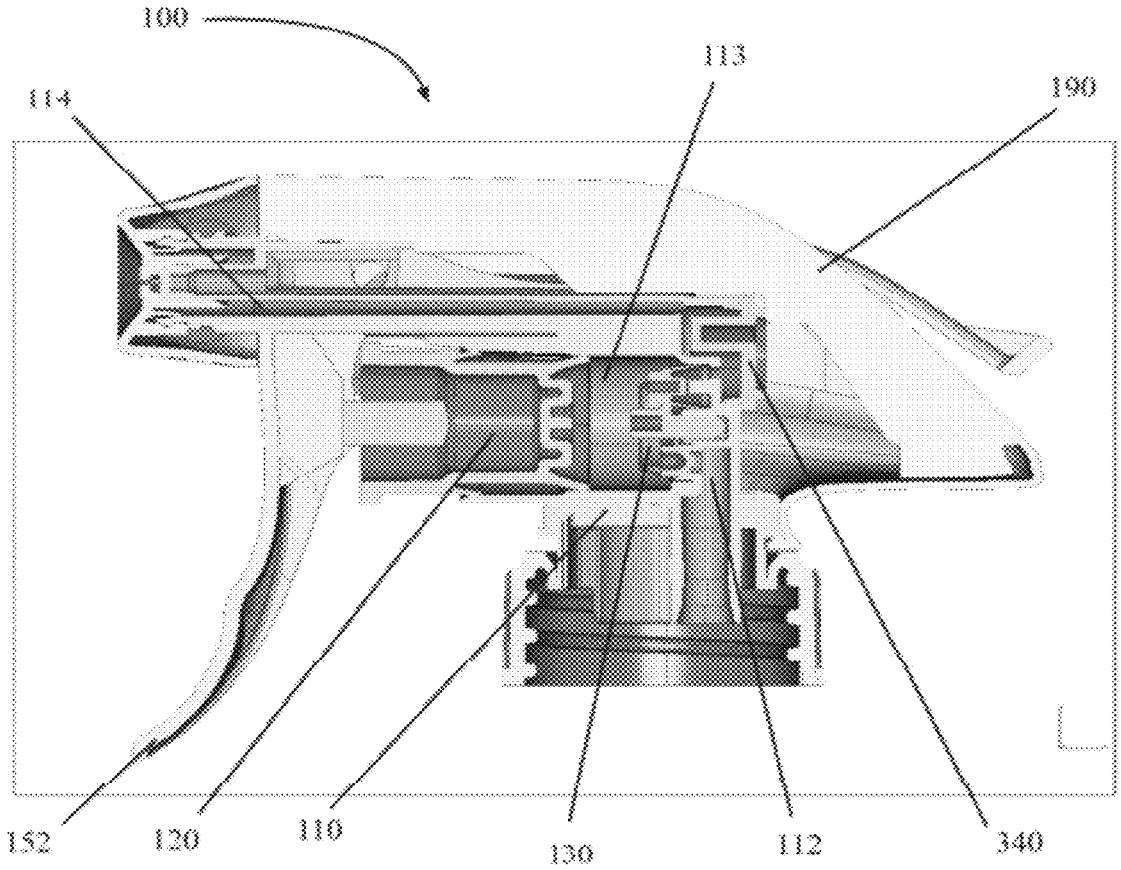
FIG. 12 illustrates a cross-sectional view of a trigger sprayer according to various embodiments of the invention.

A trigger sprayer 100 according to other embodiments of the invention is illustrated in FIG. 12. As illustrated, a trigger sprayer 100 according to embodiments of the invention may include a valve 130 having both an inlet valve and an outlet valve. For example, a valve system such as that disclosed in U.S. Pat. No. 7,175,056 may be used with various embodiments of the invention. Such a valve system may be used for a trigger sprayer 100 which does not or may not include a pre-compression system. However, such a valve system may be used with a valve body 110 similar to or identical to the valve body 110 used with other embodiments of the invention.

According to embodiments of the invention, a trigger sprayer 100 may include a plug 340 in place of a discharge valve 240. A plug 340 may seal an opening in the valve body 110 where a discharge valve 240 could be placed and may allow a product discharged from a pump chamber 113 to flow past the plug towards the outlet 114. Thus, a valve body 110 according to various embodiments of the invention may be used to assemble either a pre-compression type trigger sprayer 100 as illustrated in FIG. 3 or a non-pre-compression type trigger sprayer 100 as illustrated in FIG. 12. For example, if a pre-compression type trigger sprayer 100 is desired, a valve body 110 may be assembled with a discharge valve 240 according to embodiments of the invention. If a non-pre-compression type trigger sprayer 100 is desired, a valve body 110 may be assembled with a valve 130 having an inlet valve and an outlet valve and a plug 340 may be used in place of the discharge valve 240.

Figure 13:
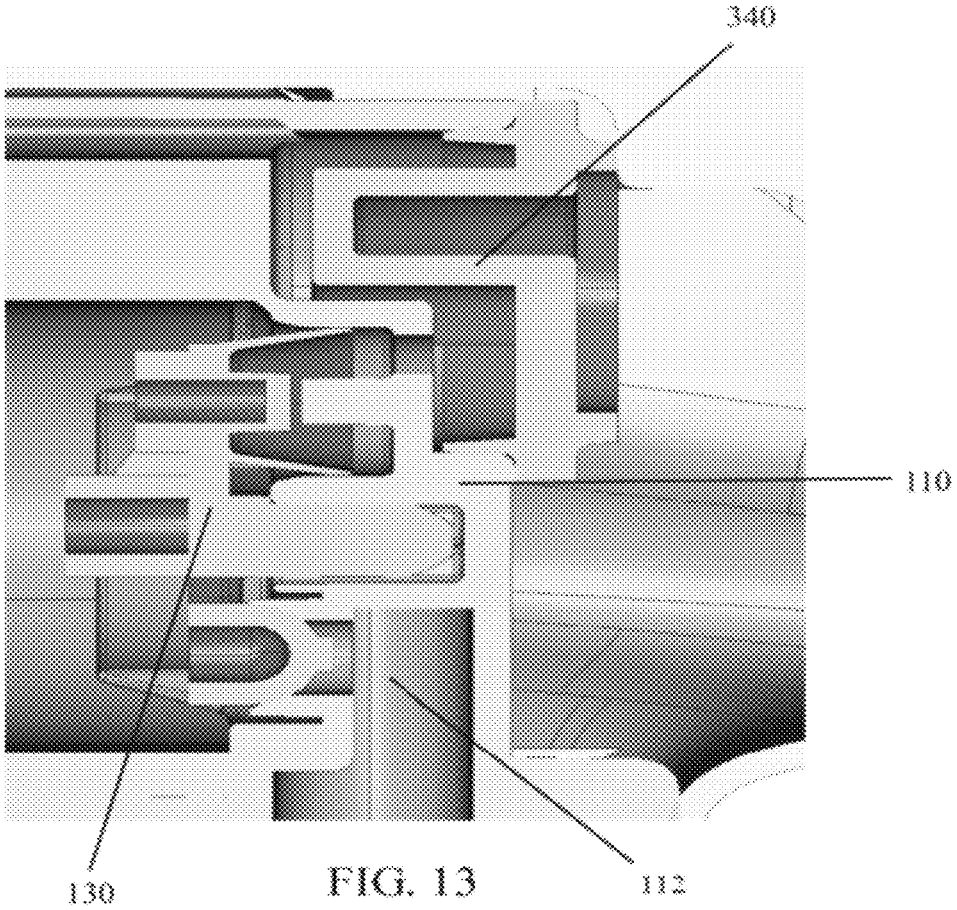
FIG. 13 illustrates a valve and plug system according to various embodiments of the invention.

A cross-sectional, close-up view of a valve 130 and plug 340 combination assembled with a valve body 110 is illustrated in FIG. 13.

Figure 14:
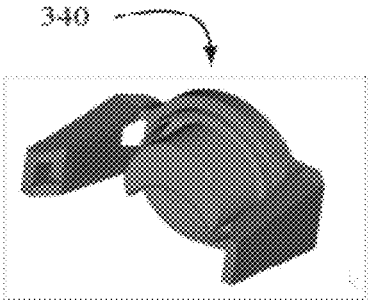
FIG. 14 illustrates a plug according to various embodiments of the invention.
Figure 15:
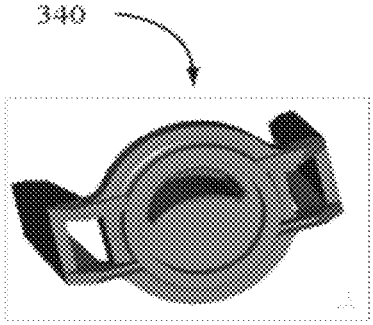
FIG. 15 illustrates a plug according to various embodiments of the invention.

A plug 340 according to embodiments of the invention may be made of any desired material and in any desired shape. A plug 340 design according to certain embodiments of the invention is illustrated in FIGS. 14 and 15. As illustrated, a plug 340 may include features similar to a discharge valve 240 in that it may include projections or other features which may be used to secure a plug 340 to a valve body 110. The configuration or shape of the plug 340 may also be altered to fit the valve body 110 as desired and to provide a product flow path from the pump chamber 113 to the outlet 114.

Figure 16:
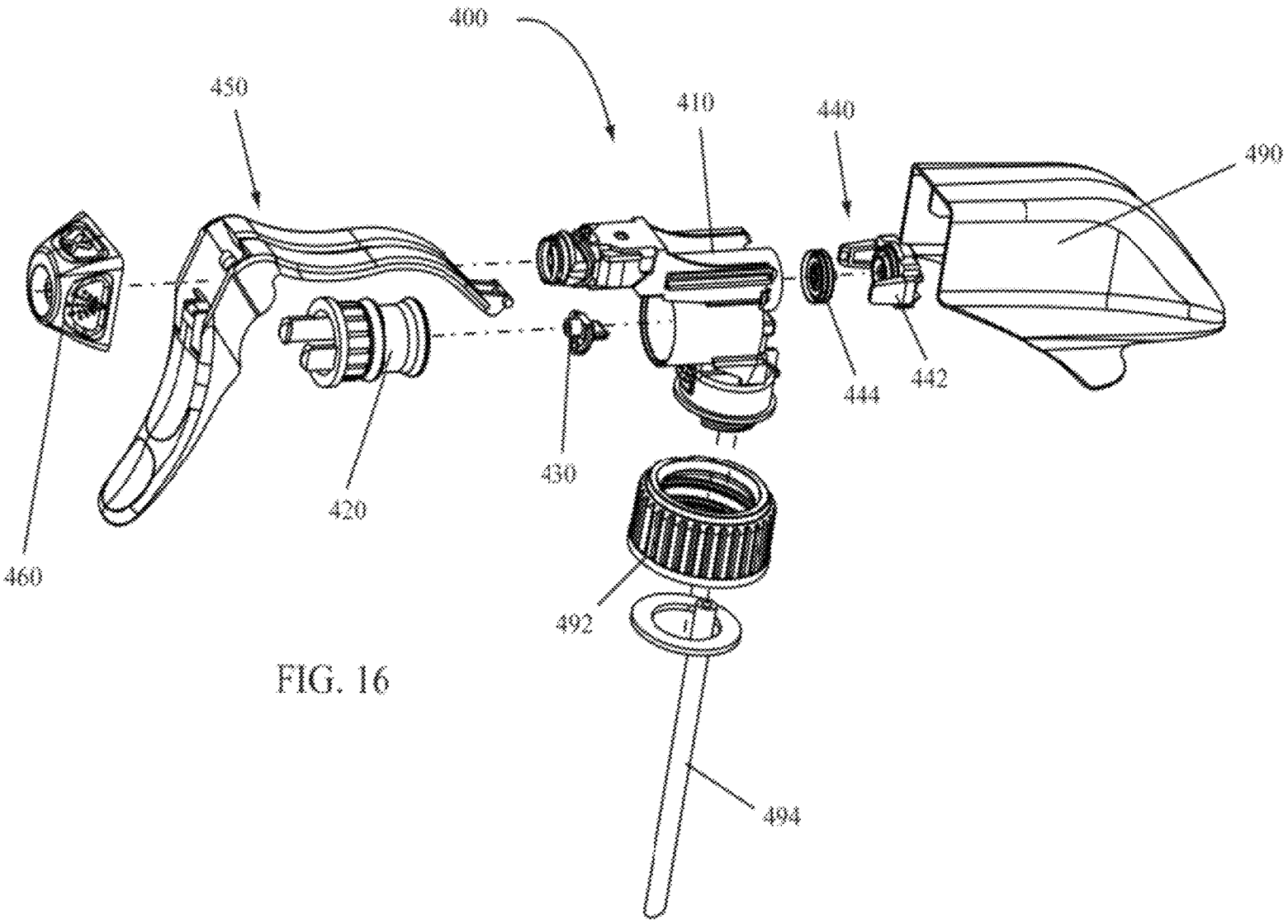
FIG. 16 illustrates an exploded-view of a trigger sprayer according to various embodiments of the invention.

An exploded view of a trigger sprayer 400 according to still other embodiments of the invention is illustrated in FIG. 16. As shown, a trigger sprayer 400 may include an assembly of a valve body 410, an inlet valve 430, an actuator 450, a piston 420, a nozzle 460, a shroud 490, an attachment system 492, a dip tube 494, and a discharge valve 440. As illustrated in FIG. 16, the discharge valve 440 may include a frame 442 and a valve 444 wherein the frame 442 may attach to or snap-fit with the valve body 410 and may secure the valve 444 on, against, or in proximity to a valve seat of the valve body 410.

Conventional methods may be used to assemble a trigger sprayer 400 such as that illustrated in FIG. 16 and components such as the nozzle 460, shroud 490, attachment system 492, dip tube 494, piston 420, actuator 450 and valves may be assembled as desired. In addition, a trigger sprayer 400 according to embodiments of the invention may be assembled to a bottle or other container as desired and known in the art. For example, a screw-on attachment system 492 may be used to attach a trigger sprayer 400 to a bottle having a corresponding screw-type thread system. In other examples, a valve body 410 may include a bayonet-type attachment system 492 which may be mated with and attached to a bottle or container having corresponding bayonet connectors.

Figure 17:
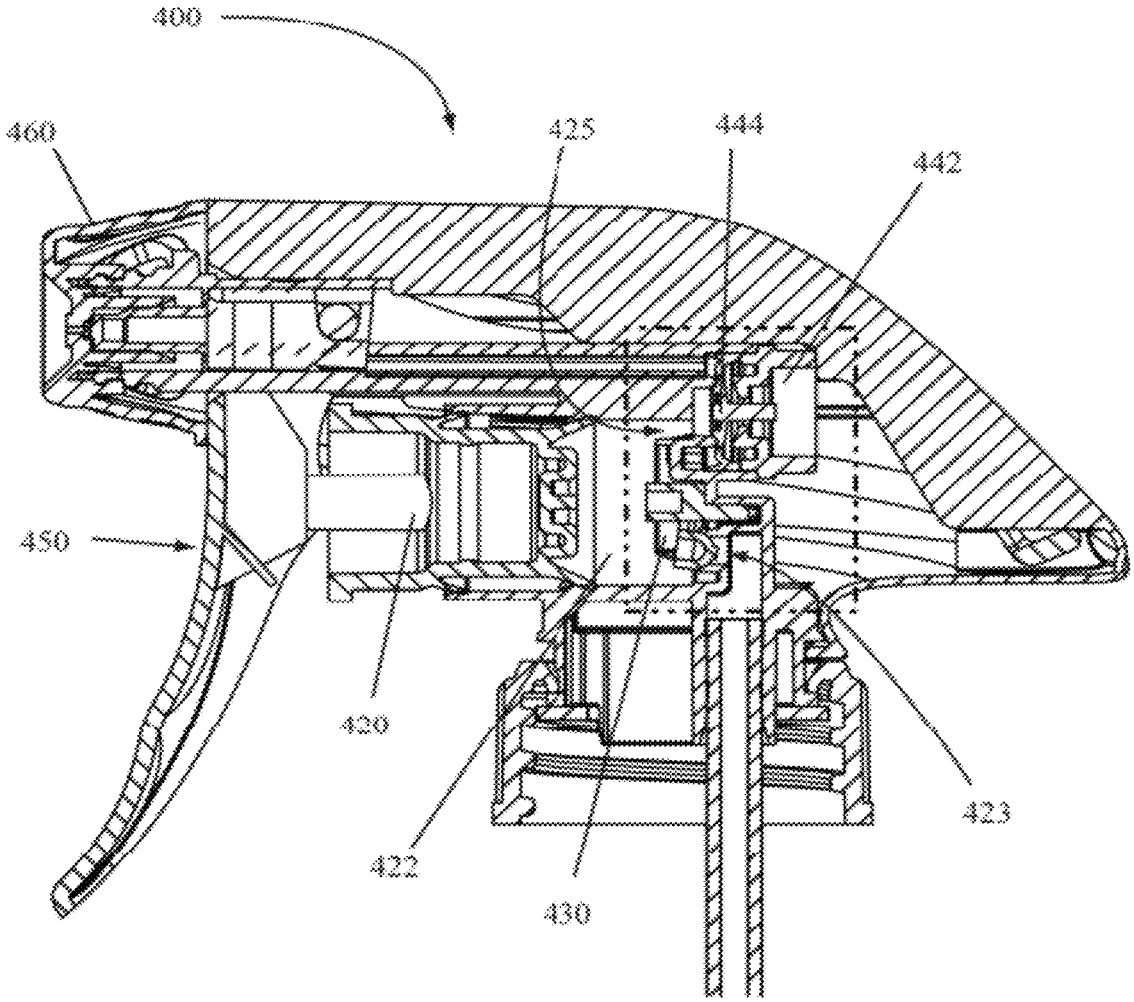
FIG. 17 illustrates a cross-sectional view of a trigger sprayer according to various embodiments of the invention.

A cross-sectional view of an assembled trigger sprayer 400 according to some embodiments of the invention is illustrated in FIG. 17. As illustrated, the trigger sprayer 400 is in a non-actuated position having a piston 420 seated in a variable volume pump chamber 422. A portion of an inlet valve 430 is seated against a pump chamber inlet 423 and a portion of a discharge valve 440 is seated against a pump chamber outlet 425.

Figure 18:
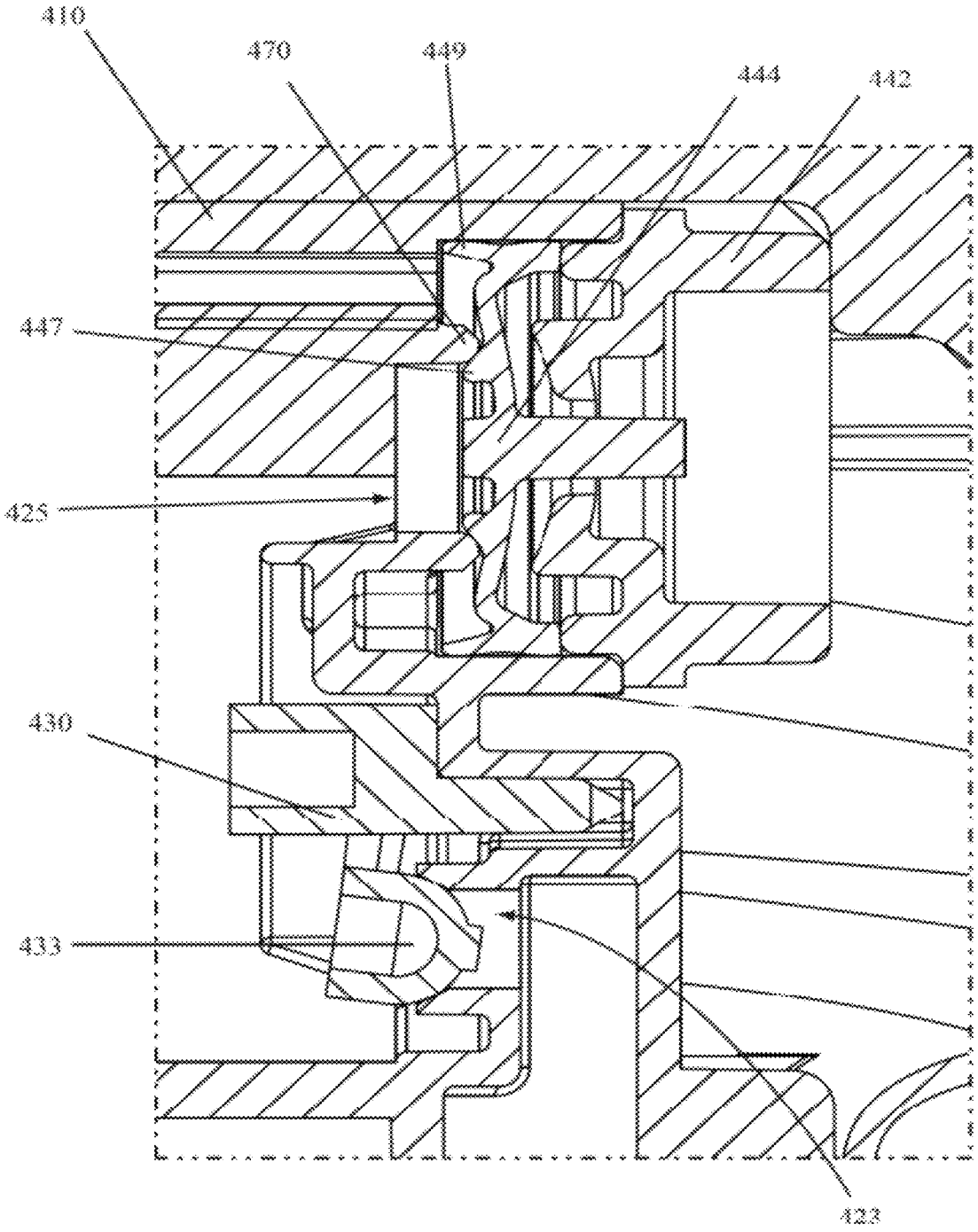
FIG. 18 illustrates a close-up view of a portion of the trigger sprayer illustrated in FIG. 17.

A blown-up view of the inlet valve 430 and discharge valve 440 encompassed by the dotted lines in FIG. 17 is illustrated in FIG. 18. As illustrated, an inlet valve 430 may be seated in a pump chamber 422 with an inlet valve member 433 seated against a pump chamber inlet 423. A valve 444 of a discharge valve 440 may be seated against a valve seat 470 surrounding the pump chamber outlet 425 as illustrated. A frame 442 may secure the valve 444 against the valve seat 470 and in a position of contact with the valve body 410. One or more outer edges 449 of the valve 444 may contact the valve body 410 and form a seal therewith.

Figure 19:
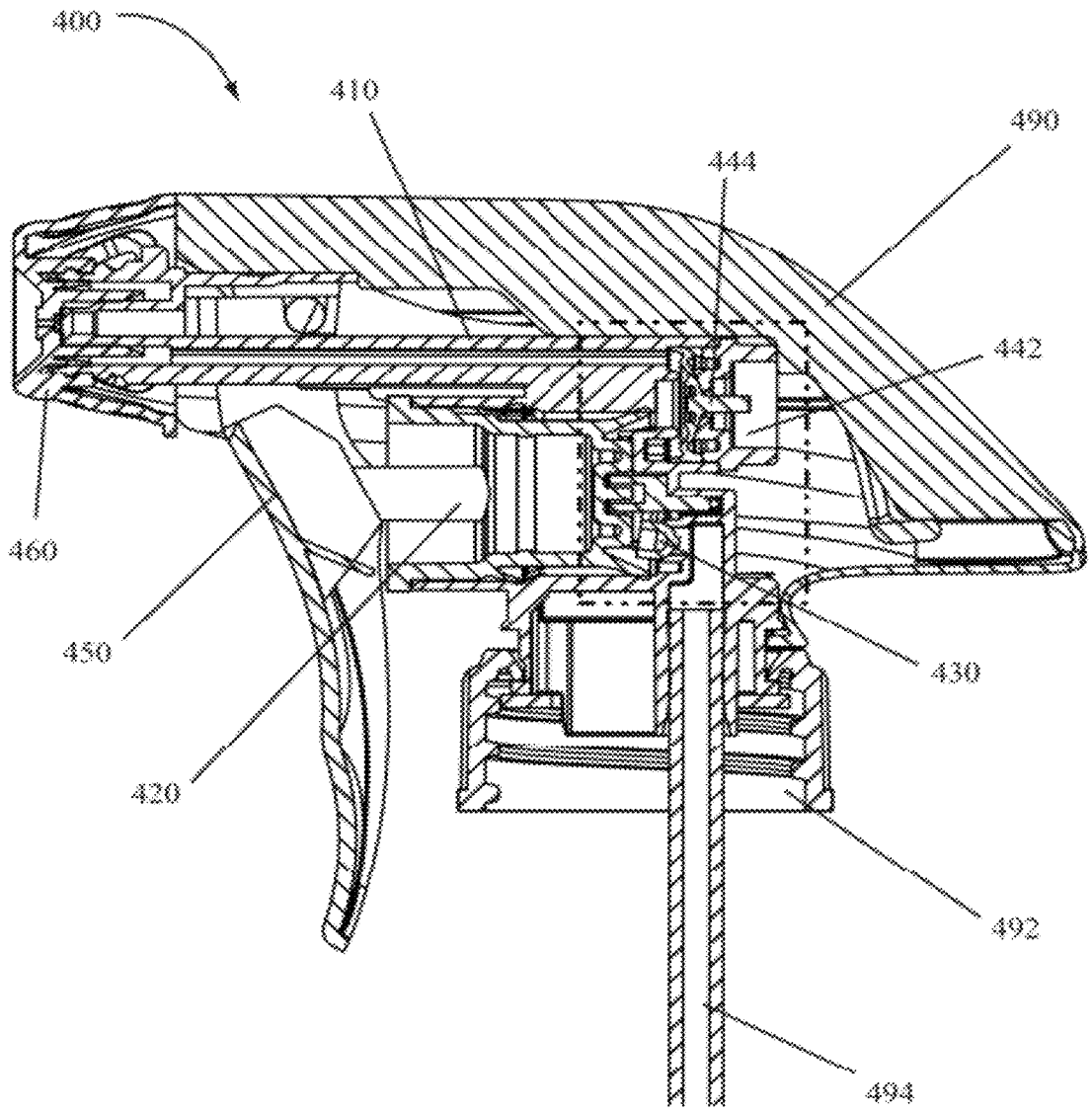
FIG. 19 illustrates a cross-sectional view of a trigger sprayer according to various embodiments of the invention.

A cross-sectional view of an assembled trigger sprayer 400 according to embodiments of the invention is illustrated in FIG. 19. As illustrated, the trigger sprayer 400 may be in an actuated or partially actuated position wherein a piston 420 has moved within a pump chamber 422, reducing the volume therein and forcing product through the pump chamber outlet 425 such that the valve 444 of the discharge valve 440 is unseated from the valve seat 470.

Figure 20:
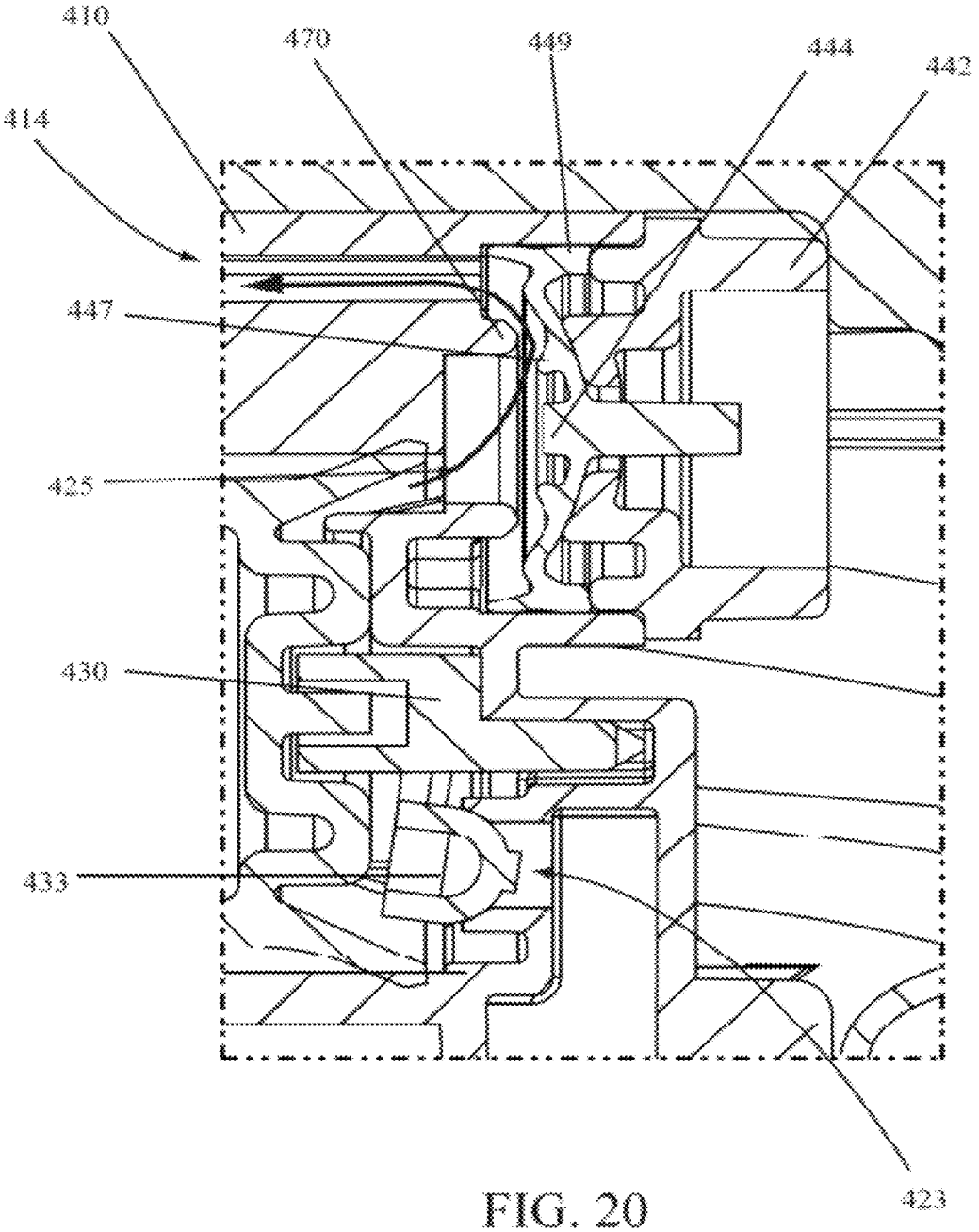
FIG. 20 illustrates a close-up view of a portion of the trigger sprayer illustrated in FIG. 19.

A blown-up view of the discharge valve 440 encompassed by the dotted lines in FIG. 19 is illustrated in FIG. 20. As illustrated, when a piston 420 is moved in a pump chamber 422 by actuation of the trigger sprayer 400, the piston forces fluid or product through the pump chamber outlet 425, past valve 444 and into the discharge passageway or outlet 414 as illustrated by the bold fluid flow path line in FIG. 20. As the piston 420 moves within the pump chamber 422, the chamber size is reduced and any fluid or product within the pump chamber 422 passes into the pump chamber outlet 425 to encounter the valve 444. Once a certain pressure on the valve 444 is reached—the cracking pressure—the valve 444 may unseat from the valve seat 470, allowing fluid or product to flow past the valve 444 and into the discharge passageway or outlet 414.

Figure 21:
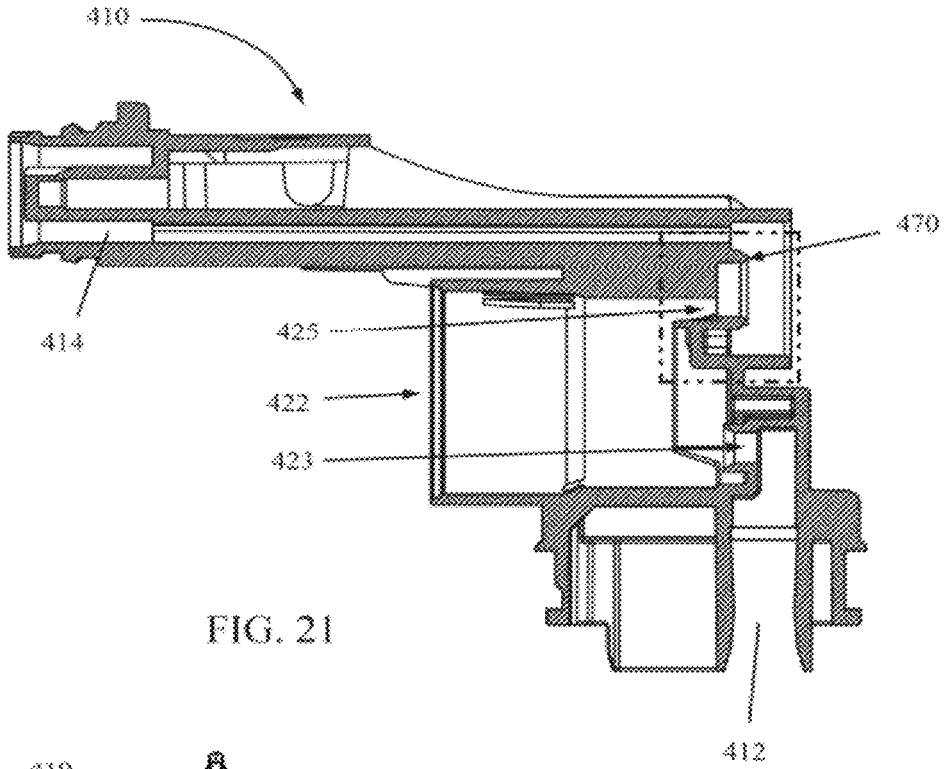
FIG. 21 illustrates a cross-sectional view of a valve body according to various embodiments of the invention.
Figure 23:
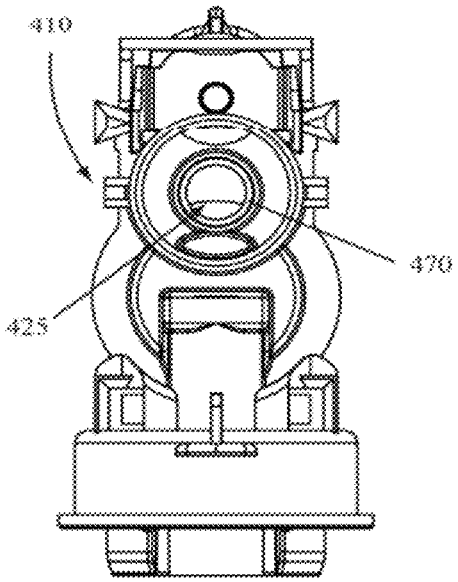
FIG. 23 illustrates a front-view of a valve body according to various embodiments of the invention.

A cross-sectional view of a valve body 410 of a trigger sprayer 400 according to various embodiments of the invention is illustrated in FIG. 21. A valve body 410 may be configured in a conventional manner and may include a pump chamber 422 which may be defined by an opening in the valve body 410 and a piston 420 inserted in the opening. The pump chamber 422 may include a pump chamber inlet 423 and a pump chamber outlet 425. Fluid or product may flow from an inlet 412 of the valve body 410 through the pump chamber inlet 423 into the pump chamber 422 and out through the pump chamber outlet 425 into the discharge passageway or outlet 414 of the valve body 410. In some embodiments of the invention, a pump chamber outlet 425 may be in direct communication with the outlet 414 or may be in indirect communication such as illustrated in FIG. 21 wherein the pump chamber outlet 425 opens to an opening in the valve body 410 which is in communication with the outlet 414. In some embodiments of the invention, the pump chamber outlet 425 may be centered along an axis which is parallel to an axis of the outlet 414. In other embodiments of the invention, the pump chamber outlet 425 may be centered along an axis which is perpendicular to an axis of the outlet 414. In still other embodiments of the invention, the pump chamber outlet 425 may be centered along an axis that is neither parallel to nor perpendicular to the axis of the outlet 414.

According to various embodiments of the invention, a discharge valve seat 470 may be located at an exit of, or end of, the pump chamber outlet 425 as illustrated in FIGS. 18 and 21 through 23. In some embodiments, the valve seat 470 may include a circular shape as illustrated. In other embodiments, the shape of the valve seat 470 may be selected as desired.

Figure 22:
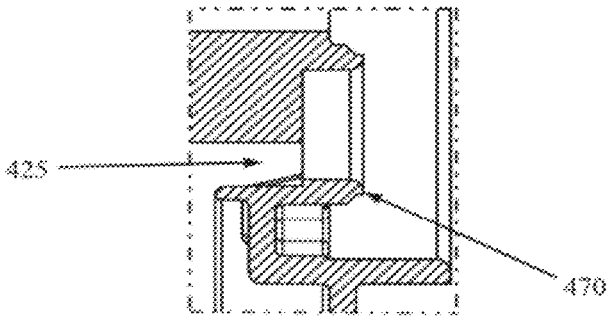
FIG. 22 illustrates a close-up view of a portion of the valve body illustrated in FIG. 21.

A close-up of the valve seat 470 and pump chamber outlet 425 designated by broken lines in FIG. 21 is illustrated in FIG. 22. In some embodiments of the invention, the valve seat 470 may include one or more features to facilitate sealing of the valve seat 470 with a valve 444. For example, a valve seat 470 may include a sealing ring, one or more lips, one or more flashes, one or more nipples, or other features configured to mate with or seal with a valve 444. A valve seat 470 may also include a rim which contacts a valve 444 making a seal therewith. In some embodiments of the invention, the valve seat 470 may include a sloped interior surface such as that illustrated in FIGS. 21 and 22 which may facilitate positioning of a portion of a valve 444 in or against the valve seat 470. For example, a close-up view of a discharge valve 440 in an assembled trigger sprayer 410 according to various embodiments of the invention is illustrated in FIG. 18. As illustrated, a valve lip 447 seats or contacts an interior of the valve seat 470. As the valve 444 is assembled to the valve body 410, the valve lip 447 may make contact with the sloped interior surfaces of the valve seat 470 and the corresponding slope on the valve lip 447 may facilitate sealing of the valve 444 with the valve seat 470 at an end of the pump chamber outlet 425. Upon actuation of a trigger sprayer 400, the valve 444 may unseat from the valve seat 470 as illustrated in FIG. 20.

Figure 24:
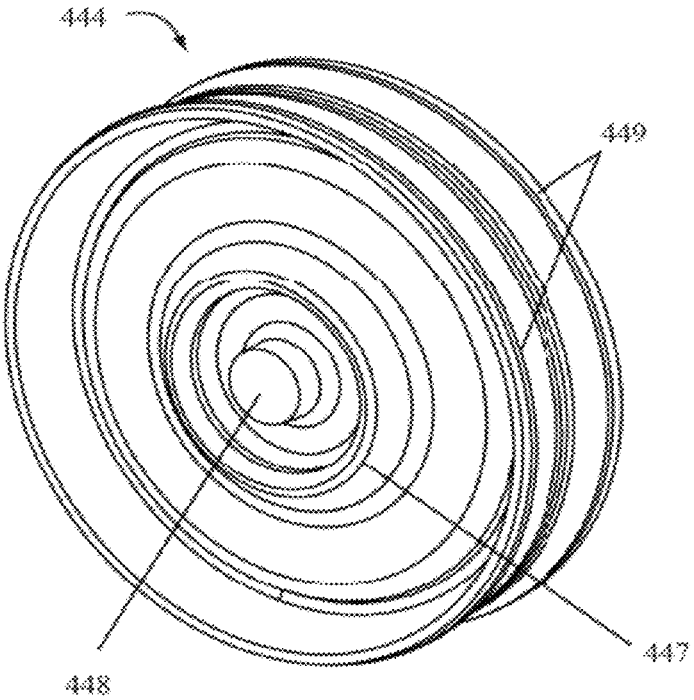
FIG. 24 illustrates a valve according to various embodiments of the invention.
Figure 25:
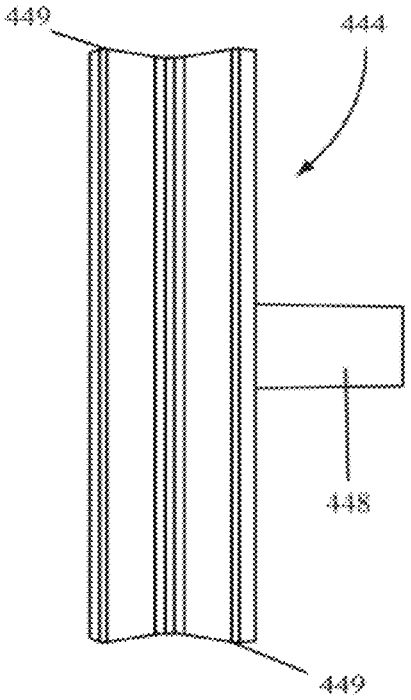
FIG. 25 illustrates a side-view of a valve according to various embodiments of the invention.
Figure 26:
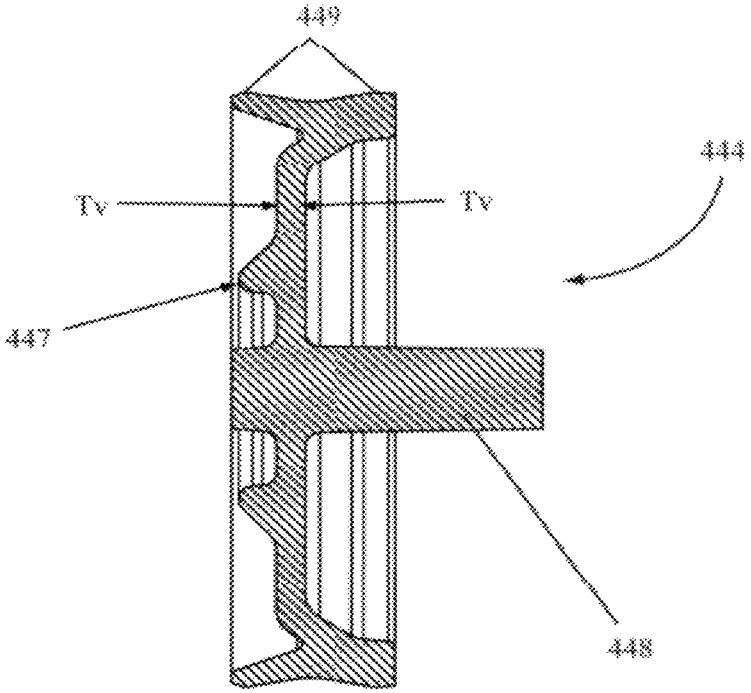
FIG. 26 illustrates a cross-sectional view of a valve according to various embodiments of the invention.

A valve 444 for use with various embodiments of the invention is illustrated in FIGS. 24 through 26. As illustrated, a valve 444 according to various embodiments of the invention may be circular in shape and may include a number of different surfaces. In some embodiments of the invention, a valve 444 may include a circular body 446 terminating in an outer circumference having one or more outer edges 449 or sealing surfaces. The body 446 may have a thickness $T_v$ as illustrated between the lines in FIG. 26. The thickness $T_v$ may also vary along the surface of the body 446. For example, the thickness $T_v$ may vary where other features occur along the surface of the body 446 such as at a location of a valve lip 447 or an outer surface having one or more outer edges 449.

As illustrated in FIGS. 24 through 26, a valve 444 may include two outer edges 449. The circumference along the one or more outer edges may be identical or different. In addition, a portion of the body 446 between one or more outer edges 449 may have a smaller circumference than a circumference of the one or more outer edges 449. For example, as illustrated in FIGS. 24 through 26, a trough or depression exists between a first outer edge 449 and the second outer edge 449, wherein the circumference around the bottom-most point in the depression is less than the circumference around one or more of the outer edges 449.

As illustrated in FIGS. 24 through 26, a valve 444 may also include one or more valve lips 447. A valve lip 447, according to various embodiments of the invention, may include one or more surfaces configured to mate with one or more surfaces of a valve seat 470 on a pump chamber outlet 425. As illustrated in FIGS. 24 through 26, a valve lip 447 may include a sloping surface configured to mate with a valve seat 470. According to various embodiments of the invention, a valve lip 447 may be shaped or configured to seal against a valve seat 470 to prevent the flow of a product past the valve lip 447 until a certain force or pressure against the valve 444 is reached. The slope or shape of the valve lip 447 may ensure a seal against a valve seat 470. For example, as illustrated in FIG. 24, a valve lip 447 may be circular in shape and may include one or more sloping surfaces which may mate with, or seal with, a circular valve seat 470 on a valve body 410. A valve lip 447 may seat within, or seal with, an interior portion of a valve seat 470 or a pump chamber outlet 425.

In certain embodiments of the invention, a valve 444 may also include one or more valve stems 448. As illustrated in FIGS. 24 through 26, a single valve stem 448 may be included with certain embodiments. A valve stem 448 may extend outwards from a body 446 on one or both sides of the body 446. As illustrated, a valve stem 448 may be perpendicular to the body 446. In other embodiments, a valve stem 448 may extend away from a body 446 at another angle. According to some embodiments of the invention, a valve stem 448 may configured or shaped to facilitate the assembly of a valve 444 with a trigger sprayer 400. In some embodiments, a valve stem 448 may extend through a portion of a frame 442.

A valve 444 having a valve lip 447 seated against a valve seat 470 is illustrated in FIG. 18. As illustrated, when a valve 444 is seated in an assembled trigger sprayer 400, the valve lip 447 may seat against or seal against the valve seat 470. The seating of the valve lip 447 against the valve seat 470 and the positioning of the valve 444 in the trigger sprayer 400 may cause the body 446 to flex as illustrated in FIG. 18. Flexion of the body 446 may apply pressure on the valve lip 447 to assist with the sealing of the valve 444. In addition, pressure on the valve 444 due to placement within the trigger sprayer 400 may apply pressure to the one or more outer edges 449 of the valve 444, sealing the one or more outer edges 449 to the valve body 410 such that product in a discharge passageway or outlet 414 may not leak past the valve 444 and into other portions of the trigger sprayer 400.

Upon actuation, a valve 444 and body 446 may be deformed as illustrated in FIG. 20, allowing product to flow past the valve 444. Upon the application of pressure or force against the valve 444 caused by actuation of the trigger sprayer 400, the one or more valve lips 447 may unseat from the valve seat 470. Movement of the body 446 may be stopped by the positioning of the frame 442 next to the valve 444. For example, as illustrated in FIG. 20, a back portion of the body 446 may contact the frame 442 such that continued flexion or movement of the body 446 is stopped and the fluid flow passage past the valve 444 is fixed. Upon a decrease in the pressure applied to the valve 444, the valve 444 may return to the non-actuated position illustrated in FIG. 18, stopping the flow of fluid or product past the valve 444.

Figure 27:
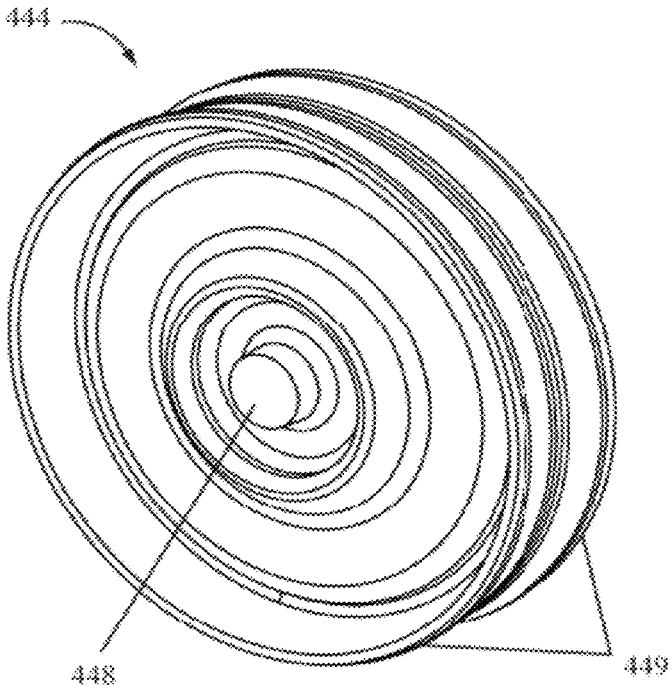
FIG. 27 illustrates a valve according to various embodiments of the invention.
Figure 28:
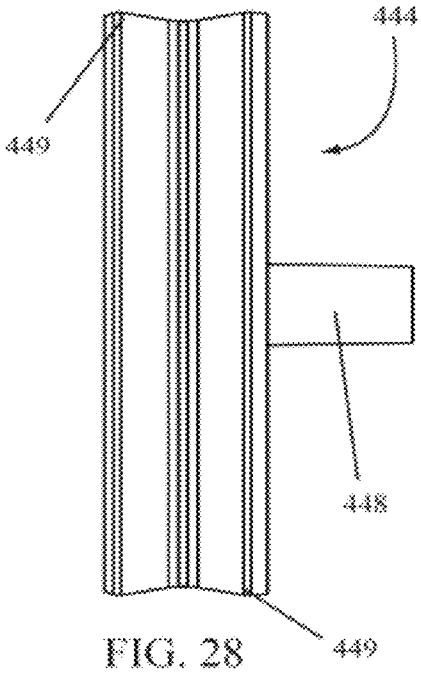
FIG. 28 illustrates a side-view of a valve according to various embodiments of the invention.
Figure 29:
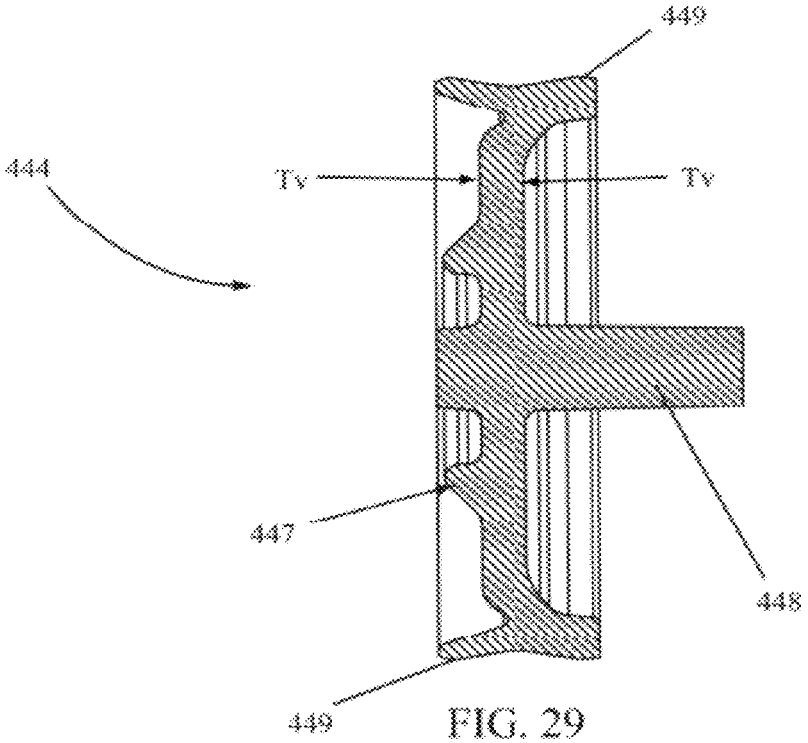
FIG. 29 illustrates a cross-sectional view of a valve according to various embodiments of the invention.

A valve 444 for use with various embodiments of the invention is illustrated in FIGS. 27 through 29. The illustrated valve 444 is similar to the valve illustrated in FIGS. 24 through 26, however, the valve 444 illustrated in FIGS. 27 through 29 has a greater thickness $T_v$.

A body 446 according to various embodiments of the invention may include a thickness $T_v$ of about 0.50 millimeters (0.019 inches). In other embodiments, a thickness $T_v$ may be about 0.80 millimeters (0.032 inches). While any thickness $T_v$ may be used with embodiments of the invention, in some embodiments, a body 446 may have a thickness $T_v$ of between about 0.40 millimeters (0.015 inches) and about 0.90 millimeters (0.036 inches). According to other embodiments of the invention, a body 446 may have a thickness $T_v$ of between about 0.25 millimeters (0.009 inches) and about 1.25 millimeters (0.05 inches). According to still other embodiments of the invention, a thickness $T_v$ along the body 446 may vary, including thicker portions and thinner portions as desired. The thickness $T_v$ of the body 446 may be selected or designed to provide a desired resistance or minimum cracking pressure needed to unseat the one or more valve lips 447 from a valve seat 470.

A valve 444 according to various embodiments of the invention may be made of any desired material. In some embodiments, a valve 444 may be formed of an elastic material or material capable of deforming and returning to a non-deformed state. In certain embodiments, a valve 444 may be formed of an olefin based polymer, silicon, other polymer material, or plastic material. While various materials are described, other materials may also be used and the various embodiments of the invention are not limited by the selection of materials for the valve 444.

Figure 30:
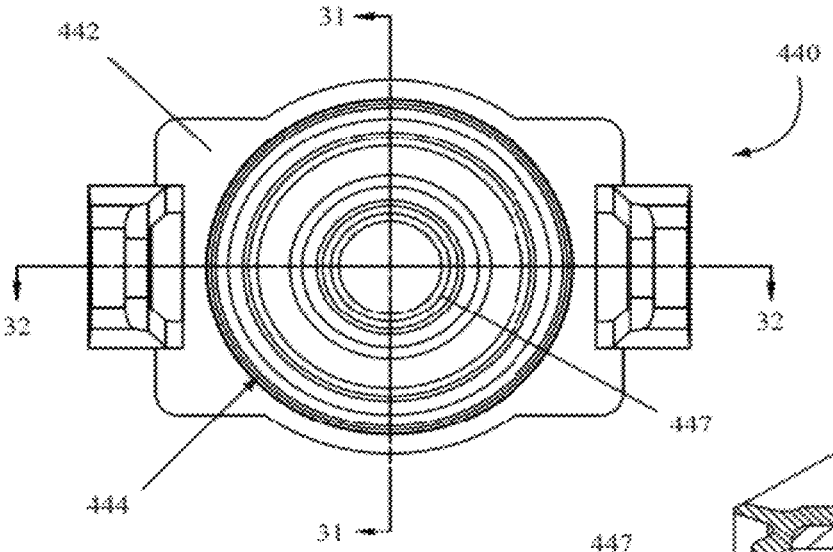
FIG. 30 illustrates a discharge valve according to various embodiments of the invention.
Figure 31:
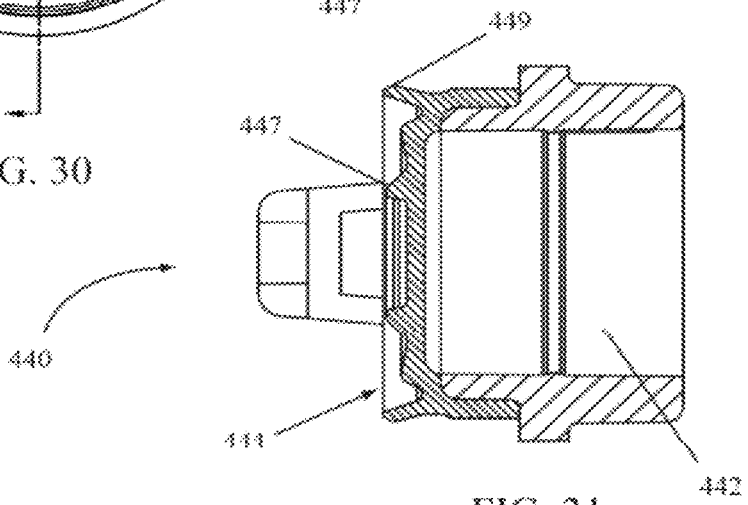
FIG. 31 illustrates a cross-sectional view of a discharge valve according to various embodiments of the invention.
Figure 32:
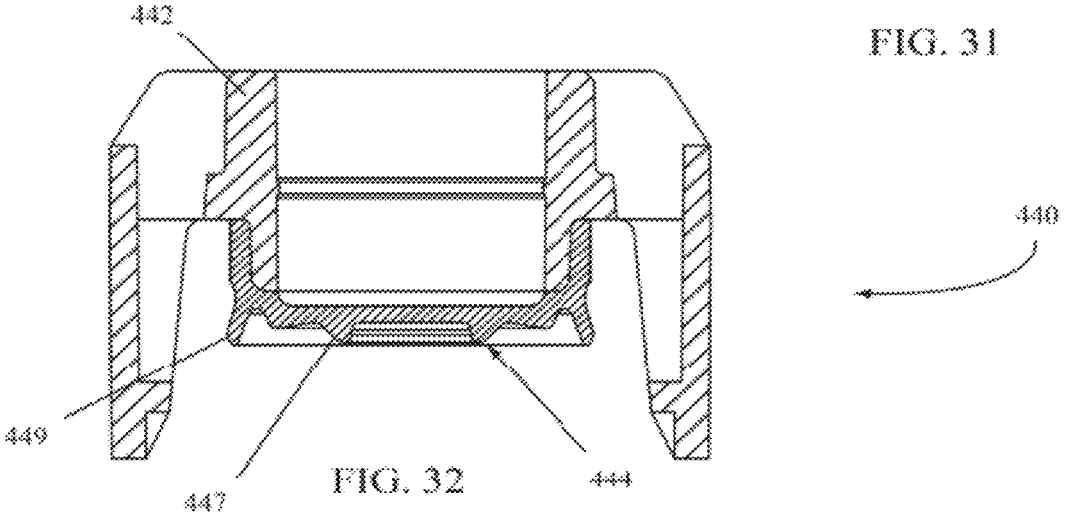
FIG. 32 illustrates a cross-sectional view of a discharge valve according to various embodiments of the invention.

A discharge valve 440 including a frame 442 and valve 444 combination according to various embodiments of the invention is illustrated in FIGS. 30 through 32. As illustrated, a valve 444 may be a part of, molded with, or connected to a frame 442 as illustrated. A valve 444 may include one or more valve lips 447 and one or more outer edges 449. In some embodiments of the invention, the one or more valve lips 447 may seat with a valve seat 470 of a trigger sprayer to form a seal therewith. In addition, the one or more outer edges 449 may contact a portion of a valve body 410 to form a seal therewith.

Cross-sectional views of the discharge valve 440 illustrated in FIG. 30 are illustrated in FIGS. 31 and 32 as represented by the cross-section lines in FIG. 30.

Figure 33:
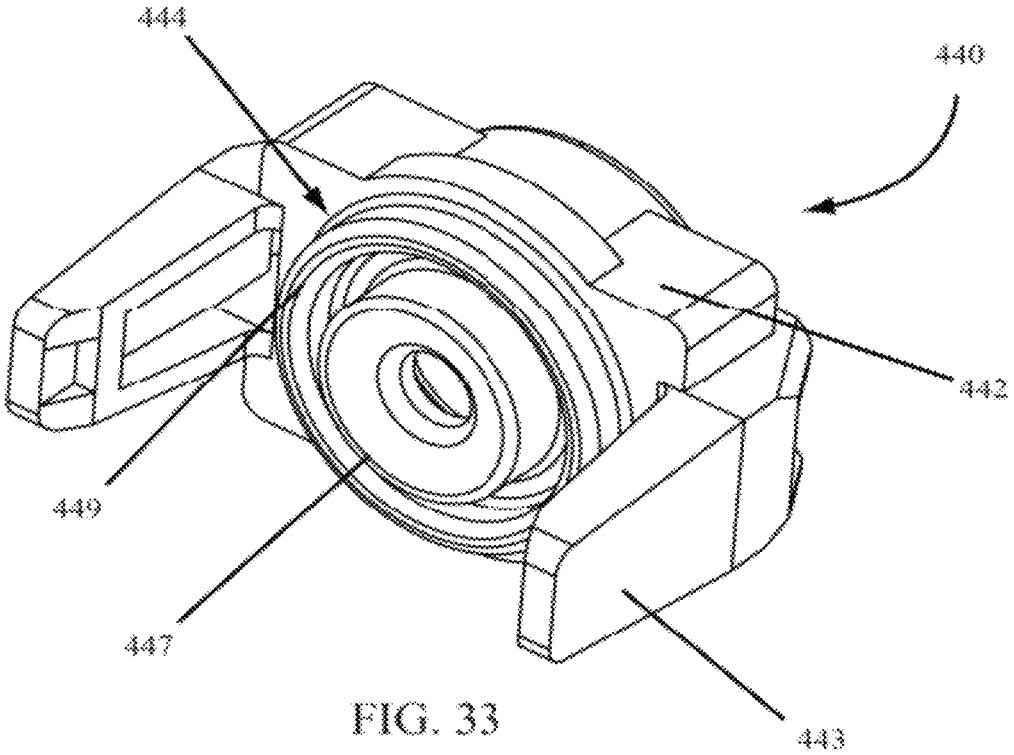
FIG. 33 illustrates a discharge valve according to various embodiments of the invention.
Figure 34:
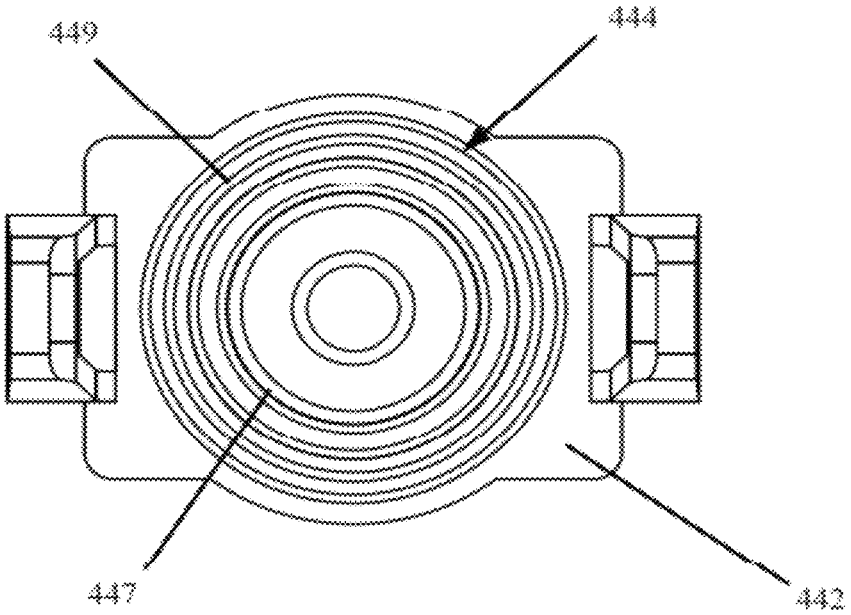
FIG. 34 illustrates a discharge valve according to various embodiments of the invention.

A discharge valve including a frame 442 and valve 444 combination according to other embodiments of the invention is illustrated in FIGS. 33 and 34. As illustrated, a valve 444 may be connected to, bi-injected with, snapped to, or otherwise secured to a frame 442. A frame 442 may include one or more latches 443 which may be configured to snap to, latch with, or otherwise secure to a valve body 410. The latching of a frame 442 to a valve body 410 may help retain a valve 444 in position such that a valve lip 447 may seat against a valve seat 470. One or more outer edges 449 may also be positioned against a valve body 410 and held in position by a frame 442 latched to a valve body 410. According to some embodiments of the invention, a frame 442 may include two latches 443 such as the opposing latches illustrated in FIGS. 33 through 36.

Figure 35:
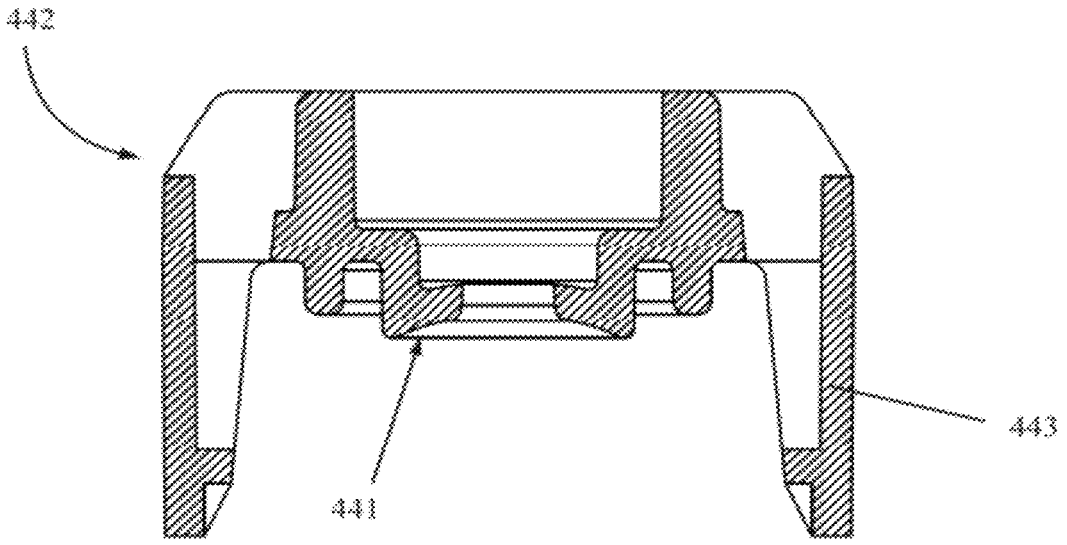
FIG. 35 illustrates a cross-sectional view of a frame of a discharge valve according to various embodiments of the invention.
Figure 36:
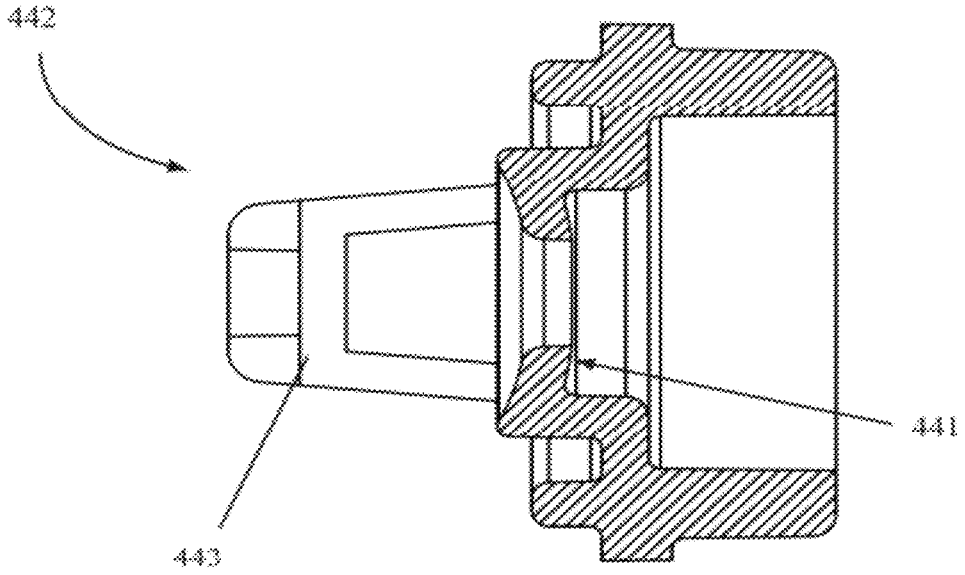
FIG. 36 illustrates a cross-sectional view of a frame of a discharge valve according to various embodiments of the invention.
Figure 40:
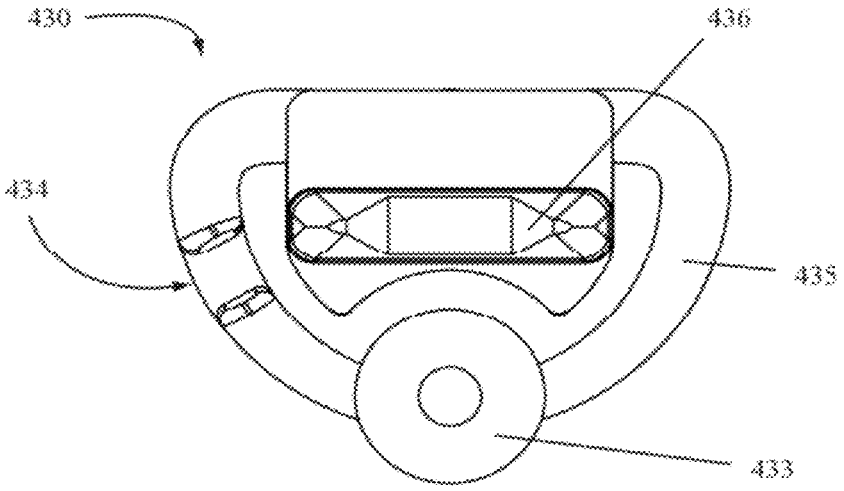
FIG. 40 illustrates a front-view of an inlet valve according to various embodiments of the invention.
Figure 41:
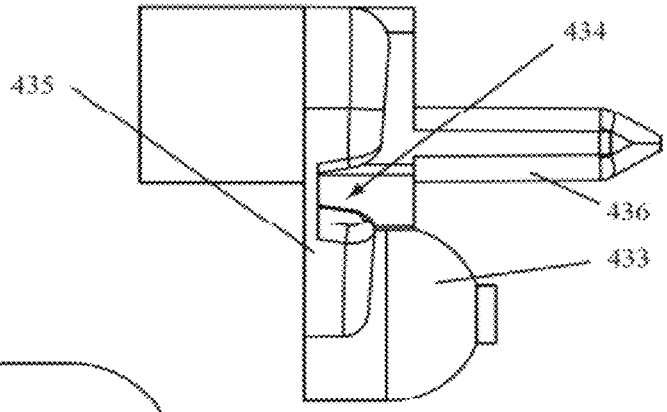
FIG. 41 illustrates a side-view of an inlet valve according to various embodiments of the invention.
Figure 42:
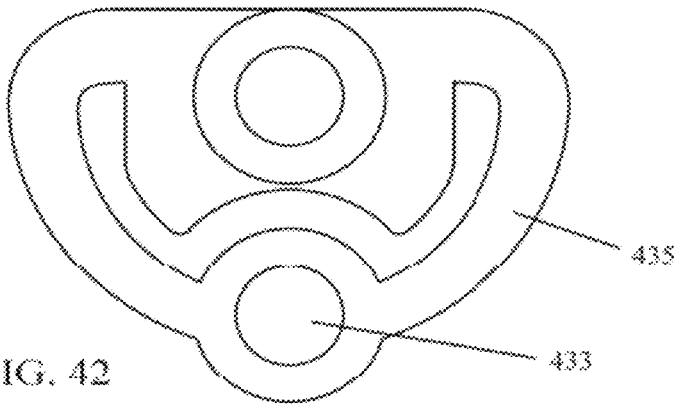
FIG. 42 illustrates a rear-view of an inlet valve according to various embodiments of the invention.

A frame 442 according to some embodiments of the invention is illustrated in FIGS. 35 and 36. A frame 442 may be made of any desirable material; for example, a frame 442 according to certain embodiments of the invention may be molded of a plastic or resin material. A frame 442 may include one or more latches 443 extending therefrom. A latch 443 may be configured to secure to a valve body 410. Any type of latch or securing system may be used to secure a frame 442 to a valve body 410 as desired.

In some embodiments of the invention, a valve 444 may be secured to the frame 442 as illustrated in FIGS. 30 through 34. According to other embodiments of the invention, a frame 442 may be assembled with a valve 444 such that a valve 444 is held between a valve body 410 and the frame 442 as illustrated in FIGS. 18 and 20.

According to certain embodiments of the invention, a frame 442 may include a frame rim 441 as illustrated. A frame rim 441 may include a circular, or other shaped, opening through which a portion of a valve 444, such as a valve stem 448, may extend. According to various embodiments of the invention, a frame rim 441 may stop a valve 444, or portion of a valve 444, from moving along an axis of the valve 444 during actuation of a trigger sprayer 400. For example, as illustrated in FIG. 20, when actuated, a valve 444 or body 446 portion may flex such that the one or more valve lips 447 unseat from a valve seat 470. The frame rim 441 may stop the movement of the body 446 or valve 444 such that a fixed opening size or flow path through the valve seat 470 and past the valve 444 is available. In addition, a frame rim 441 may decrease the wear on a valve 444 as it limits the extension or flexion of the valve 444 during actuation.

As illustrated in FIG. 20, a frame 442 may also assist with the seating of the one or more outer edges 449 against a valve body 410. The frame 442 may hold the one or more outer edges 449 of the valve 444 in position within the trigger sprayer 400 such that the outer edges 449 seal against the valve body and help to retain the valve 444 in a position to allow the valve 444 to stop the flow of product from a piston chamber when a trigger sprayer 400 is not being actuated.

A valve body 410 according to other embodiments of the invention is illustrated in FIGS. 37 and 39. As illustrated, the valve body 410 may include an alternative configuration for accepting an alternative inlet valve 430. A valve body 410 may include a pump chamber inlet 423 and a pump chamber outlet 425 similar to other embodiments of the invention. A valve seat 470 may also be included on one end of the pump chamber outlet 425. The valve body 410 may be configured to retain one or more of the inlet valves 430 illustrated in FIGS. 40 through 50.

An inlet valve 430 according to some embodiments of the invention is illustrated in FIGS. 40 through 43. As illustrated, an inlet valve 430 may include an inlet valve member 433 configured to sit in, or seat against, a pump chamber inlet 423 and act as a valve into the pump chamber. An inlet valve 430 may also include a valve arm 435 supporting the inlet valve member 433. The valve arm 435 may be flexible such that the inlet valve member 433 may move in response to operation of a trigger sprayer 400. The valve arm 435 may also include one or more valve arm openings 434. The one or more valve arm openings 434 may allow the valve arm to flex or may be sized and shaped to alter the amount of force required to flex the valve arm 435 to move the inlet valve member 433. An inlet valve 430 may also include one or more posts 436 which may secure within one or more openings of a valve body 410 to secure the inlet valve 430 within a pump chamber.

Figure 43:
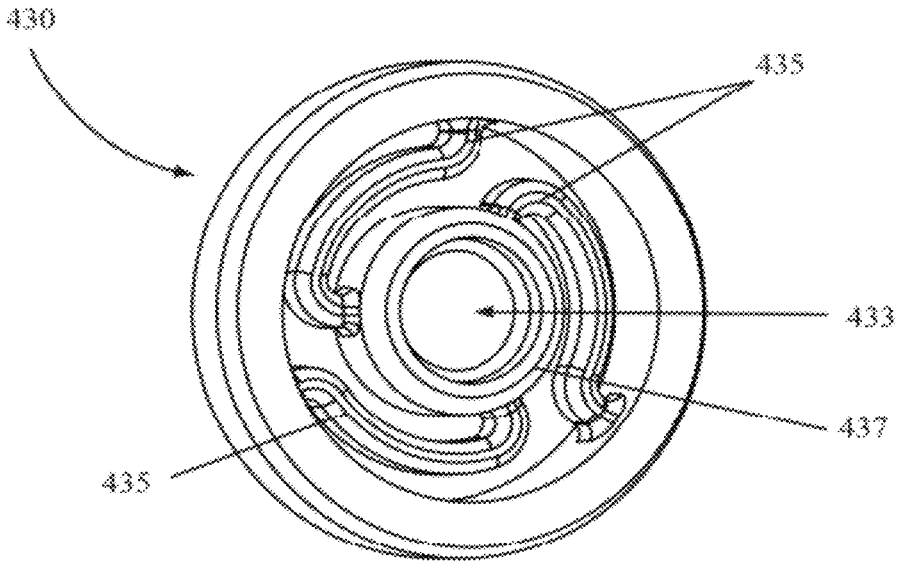
FIG. 43 illustrates an inlet valve according to various embodiments of the invnetion.
Figure 45:
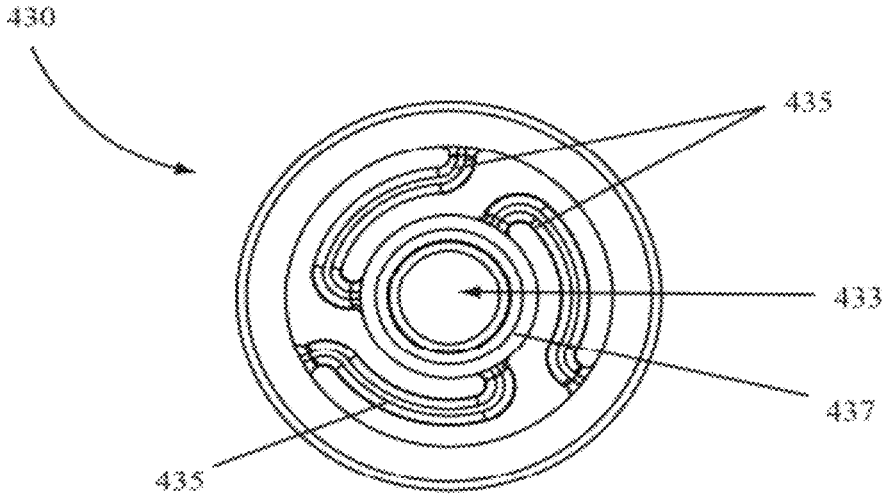
FIG. 45 illustrates an inlet valve according to various embodiments of the invention.
Figure 46:
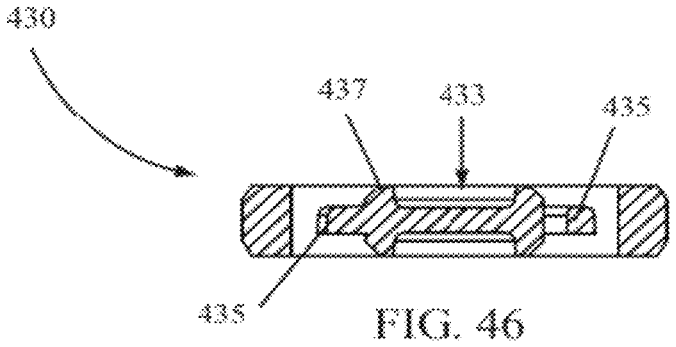
FIG. 46 illustrates a cross-sectional view of an inlet valve according to various embodiments of the invention.

An inlet valve 430 according to other embodiments of the invention is illustrated in FIGS. 43, 45 and 46. As illustrated in FIG. 43, an inlet valve 430 may include a circular support structure, three valve arms 435 and an inlet valve member 433 connected to the three valve arms 435. Each of the three valve arms 435 may flex and may allow movement of the inlet valve member 433. The inlet valve member 433 may also include a valve seal 437 which may seal against a portion of a pump chamber inlet 423 to form a seal therewith.

Alternative views of the inlet valve 430 illustrated in FIG. 43 are illustrated in FIGS. 45 and 46.

Figure 44:
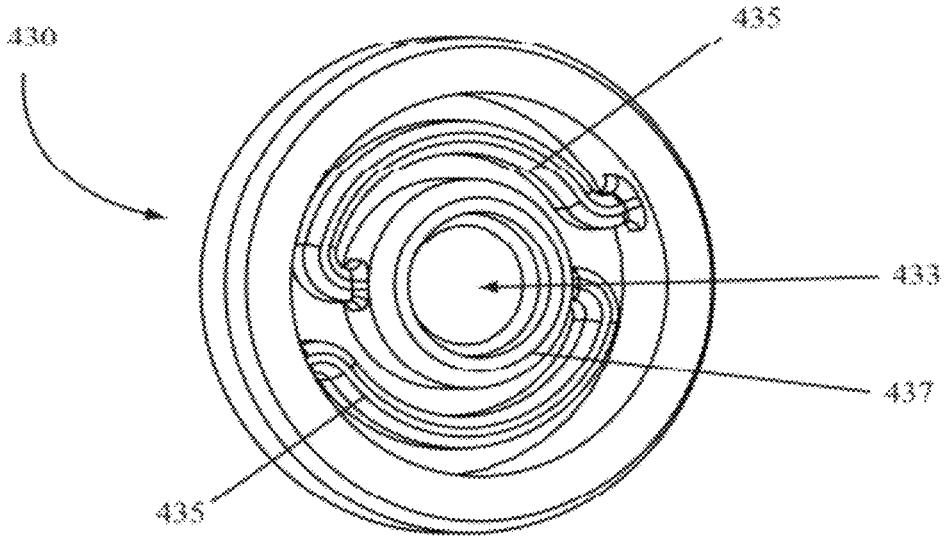
FIG. 44 illustrates an inlet valve according to various embodiments of the invention.
Figure 47:
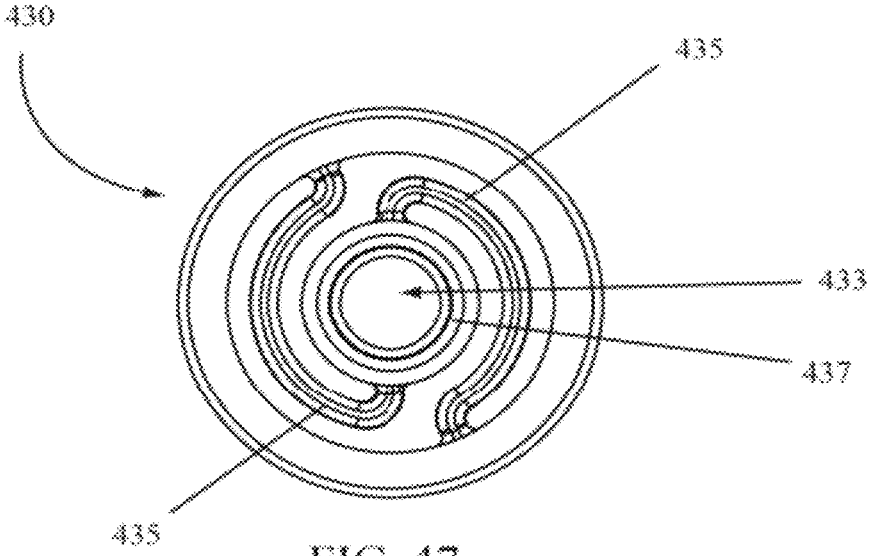
FIG. 47 illustrates an inlet valve according to various embodiments of the invention.
Figure 48:
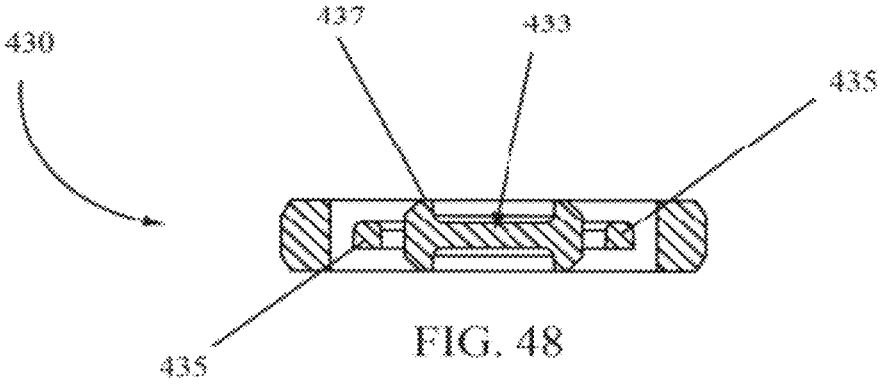
FIG. 48 illustrates a cross-sectional view of an inlet valve according to various embodiments of the invention.

An inlet valve 430 according to still other embodiments of the invention is illustrated in FIGS. 44, 47 and 48. As illustrated in FIG. 44, an inlet valve 430 may include a circular support structure, two valve arms 435 and an inlet valve member 433 connected to the two valve arms 435. Each of the two valve arms 435 may flex and may allow movement of the inlet valve member 433. The inlet valve member 433 may also include a valve seal 437 which may seal against a portion of a pump chamber inlet 423 to form a seal therewith.

Alternative views of the inlet valve 430 illustrated in FIG. 44 are illustrated in FIGS. 47 and 48.

According to various embodiments of the invention, a circular support structure of an inlet valve 430 may snap into, connect to, fit into, or otherwise be connected to a valve body 410 such that an inlet valve member 433 may sit or seal with a pump chamber inlet 423 to prevent the flow of fluid through the pump chamber inlet 423 during actuation of a trigger sprayer 400 and to allow fluid flow through the pump chamber inlet 423 upon return of the piston 420 from an actuated to a non-actuated position within the pump chamber.

While various embodiments of an inlet valve 430 are illustrated with two and three valve arms 435, it is understood that various embodiments of the invention may include more than two or three valve arms 435.

According to various embodiments of the invention, an inlet valve 430 may be made of a flexible material. For example, an inlet valve 430 may be made of silicon, rubber, an olefin based polymer, a urethane based polymer, or other polymer materials.

While various materials are disclosed herein for use in forming discharge valves and plugs, it is understood that embodiments of the invention are not limited to the use of such materials and that any desirable material may be selected for use with the various embodiments of the invention.

With the pre-compression systems of the various embodiments of the invention, higher cracking pressures for the discharge valve 140, 240, 440 are desired to improve the pre-compression effects on a product being pumped. However, as the cracking pressure of a discharge valve 140, 240, 440 is increased, the ability of a trigger sprayer 100 to prime is reduced. In order to overcome such issues, the compression ratio during priming may need to be improved. In order to improve the compression ratio of the trigger sprayers 100 according to various embodiments of the invention, a piston 120 may be configured or shaped to improve the compression ration. In some embodiments, for example, a rear portion of the piston 120, or the portion of the piston 120 in contact with a product within a pump chamber 113, in each of FIGS. 1, 2, 3, 9 and 10 is shaped or includes geometry which conforms to or approximates the shape and geometry of the valve body 110 and inlet valve 130 on the interior of the pump chamber 113. By altering the geometry of the piston 120 portion within the valve chamber 113 to match, or closely resemble, the geometry of the valve body 110 and inlet valve 130 within the pump chamber 113, the compression ratio of the trigger sprayer 100 may be improved or maximized. The improved compression ratio resulting from the conforming geometries of the piston 120 and geometries within the pump chamber 113 allows trigger sprayers 100 according to embodiments of the invention to prime even when the discharge valves 140, 240, 440 have higher cracking pressures.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A trigger sprayer, comprising:
- a valve body, comprising:
  - an inlet;
  - a discharge passageway;
  - a pump chamber;
  - a pump chamber inlet between the inlet and the pump chamber;
  - a pump chamber outlet between the pump chamber and the discharge passageway; and
  - a valve seat on an end of the pump chamber outlet;
- an inlet valve positioned in the pump chamber, comprising an inlet valve member seated against the pump chamber inlet; and
- a discharge valve attached to the valve body, comprising:
  - a valve, comprising:
    - a body;
    - at least one outer edge;
    - at least one valve lip; and
    - wherein the at least one valve lip is seated against the valve seat and the at least one outer edge is seated against the valve body;
  - a frame retaining the at least one outer edge of the valve in a seated position against the valve body; and
  - wherein the frame further comprises two opposing latches.

2. The trigger sprayer of claim 1, wherein the body comprises a body having a thickness $T_v$, wherein $T_v$ is between about 0.40 millimeters and about 0.90 millimeters.

3. The trigger sprayer of claim 1, wherein the body comprises a body having a thickness $T_v$ of about 0.50 millimeters.

4. The trigger sprayer of claim 1, wherein the body comprises a body having a thickness $T_v$ of about 0.80 millimeters.

5. The trigger sprayer of claim 1, wherein the at least one valve lip comprises at least one valve lip having a sloped surface.

6. The trigger sprayer of claim 1, wherein the at least one valve lip comprises a circular shaped valve lip having at least one sloped surface.

7. The trigger sprayer of claim 1, wherein the at least one outer edge comprises two outer edges.

8. The trigger sprayer of claim 1, wherein the frame further comprises a frame rim.

9. The trigger sprayer of claim 8, wherein the frame rim is configured to prevent displacement of the body past the frame rim during actuation of the trigger sprayer.

10. The trigger sprayer of claim 8, wherein the frame rim further comprises an opening through the frame rim.

11. The trigger sprayer of claim 10, wherein the valve further comprises a valve stem extending from the body and through the opening in the frame rim.

* * * * *